US011814849B2

(12) United States Patent
Abel et al.

(10) Patent No.: US 11,814,849 B2
(45) Date of Patent: Nov. 14, 2023

(54) ADJUSTABLE HANGER SYSTEM FOR MODULAR PANELS

(71) Applicant: Richard Joseph Abel, Erie, PA (US)

(72) Inventors: Richard Joseph Abel, Erie, PA (US); Elijah John Thompson, Brookville, PA (US); Evan Michael Lang, Fairview, PA (US)

(73) Assignee: Richard Joseph Abel, Erie, PA (US)

( * ) Notice: Subject to any disclaimer, the term of this patent is extended or adjusted under 35 U.S.C. 154(b) by 126 days.

(21) Appl. No.: 17/455,844

(22) Filed: Nov. 19, 2021

(65) Prior Publication Data

US 2022/0162859 A1 May 26, 2022

Related U.S. Application Data

(60) Provisional application No. 63/116,658, filed on Nov. 20, 2020.

(51) Int. Cl.
*E04F 13/08* (2006.01)
*E04B 2/58* (2006.01)

(52) U.S. Cl.
CPC ..... *E04F 13/086* (2013.01); *E04B 2/58* (2013.01); *E04F 13/0853* (2013.01); *E04F 13/0883* (2013.01)

(58) Field of Classification Search
CPC ..... E04B 2/58; E04F 13/0814; E04F 13/083; E04F 13/0853; E04F 13/0855; E04F 13/0857; E04F 13/086; E04F 13/088; E04F 13/0883
USPC ..... 52/483.1, 489.1, 489.2
See application file for complete search history.

(56) References Cited

U.S. PATENT DOCUMENTS

| | | | | |
|---|---|---|---|---|
| 8,127,507 | B1 * | 3/2012 | Bilge | E04F 13/0814 52/235 |
| 9,834,941 | B1 * | 12/2017 | Bilge | E04F 13/12 |
| 2009/0272055 | A1 * | 11/2009 | Griffiths | E04F 13/0889 52/309.3 |
| 2012/0297725 | A1 * | 11/2012 | Anastasi | E04F 13/0816 52/705 |
| 2016/0145875 | A1 * | 5/2016 | Scully | E04F 13/0816 52/698 |
| 2019/0169855 | A1 * | 6/2019 | Czyz | E04F 13/0819 |

* cited by examiner

*Primary Examiner* — William V Gilbert
(74) *Attorney, Agent, or Firm* — ARENTFOX SCHIFF LLP

(57) ABSTRACT

A hanger system includes an adjustable panel hanger. The adjustable panel hanger includes a connector member, a base member configured to removably attach to the connector member and to clamp onto a support member, wherein the base member includes a base flange, and a hanger member adjustably affixable on the base flange. Optionally, the hanger system may further include a modular panel connectable to the base member via the hanger member.

22 Claims, 22 Drawing Sheets

ADJUSTABLE HANGER SYSTEM FOR MODULAR PANELS

CROSS REFERENCE TO RELATED APPLICATIONS

This application claims the benefit of U.S. Provisional Patent Application No. 63/116,658, entitled "ADJUSTABLE HANGER SYSTEM FOR MODULAR PANELS" and filed on Nov. 20, 2020, which is expressly incorporated by reference herein in its entirety.

TECHNICAL FIELD

The described aspects relate to adjustable hanger systems for hanging wall panels.

BACKGROUND

Aspects of the present disclosure relate generally to hanger systems for panel boards, more specifically modular wall panels.

Hanger systems along with wall panel can be used to support pre-fabricated wall structures. Hanger systems allows support structures and wall panels to be placed more easily. However, in certain structures adjustable hanger systems are needed to ensure accurate alignment.

Accordingly, there exists a need for improvements in adjustable hanger systems

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

The present disclosure concerns a system and method for an adjustable hanger system for wall panels, wherein the panels may be hung without the use of substrate materials such as gypsum board and similar materials. The system involves a panel attachment system. The panel attachment system can comprise a support member, a connector member, and at least one hanger member. The support member may have a support flange. The connector member can be removably attached a base member configured to clamp on the support flange of the support member. The base member can be moveable on a first axis. The at least one hanger member may be connected to the base member. Each of the at least one hanger member can be movable on a second axis, the second axis perpendicular to the first axis.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION

Various aspects are now described with reference to the drawings. In the following description, for purposes of explanation, numerous specific details are set forth in order to provide a thorough understanding of one or more aspects. It may be evident, however, that such aspect(s) may be practiced without these specific details.

While the foregoing disclosure discusses illustrative aspects and/or embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

The present disclosure provides a novel panel attachment system implementing an adjustable panel hanger. The panel attachment system herein overcomes certain drawbacks of conventional panel board attachment techniques.

Modular panel systems, including modular panels that are mounted onto specialized metal framing systems, are often used to replace traditional wall panels, such as drywall or other boards, that are attached to vertical steel or wood studs (e.g. two-by-fours).

A problem with typical modular panel systems is that they require special metal framing systems that are different from other metal framing structures used in building construction. These special metal framing systems add substantial cost to a building project. Additionally, such systems also disrupt standard building contractor activities and timelines by requiring for exceptions to be made to utilize the special metal framing systems, and/or to tear down standard metal framing systems already in place. Moreover, typical modular panel systems require substantial structural members for hanging the modular panels.

Accordingly, the adjustable hanger system described herein allows modular panels to be easily installed and adjusted. Rather than remove the standard vertical metal studs and replace them with special metal framing systems, the adjustable hanger system can be attached to existing vertical studs or newly installed conventional vertical studs. This allows walls to be easily created in buildings, such as offices or hospitals, which can be easily constructed and adjusted. Additionally, it allows easy removal of the wall panels so there is less waste if mechanical, electrical, lighting, or plumbing adjustment needs to be made.

Figure 1:
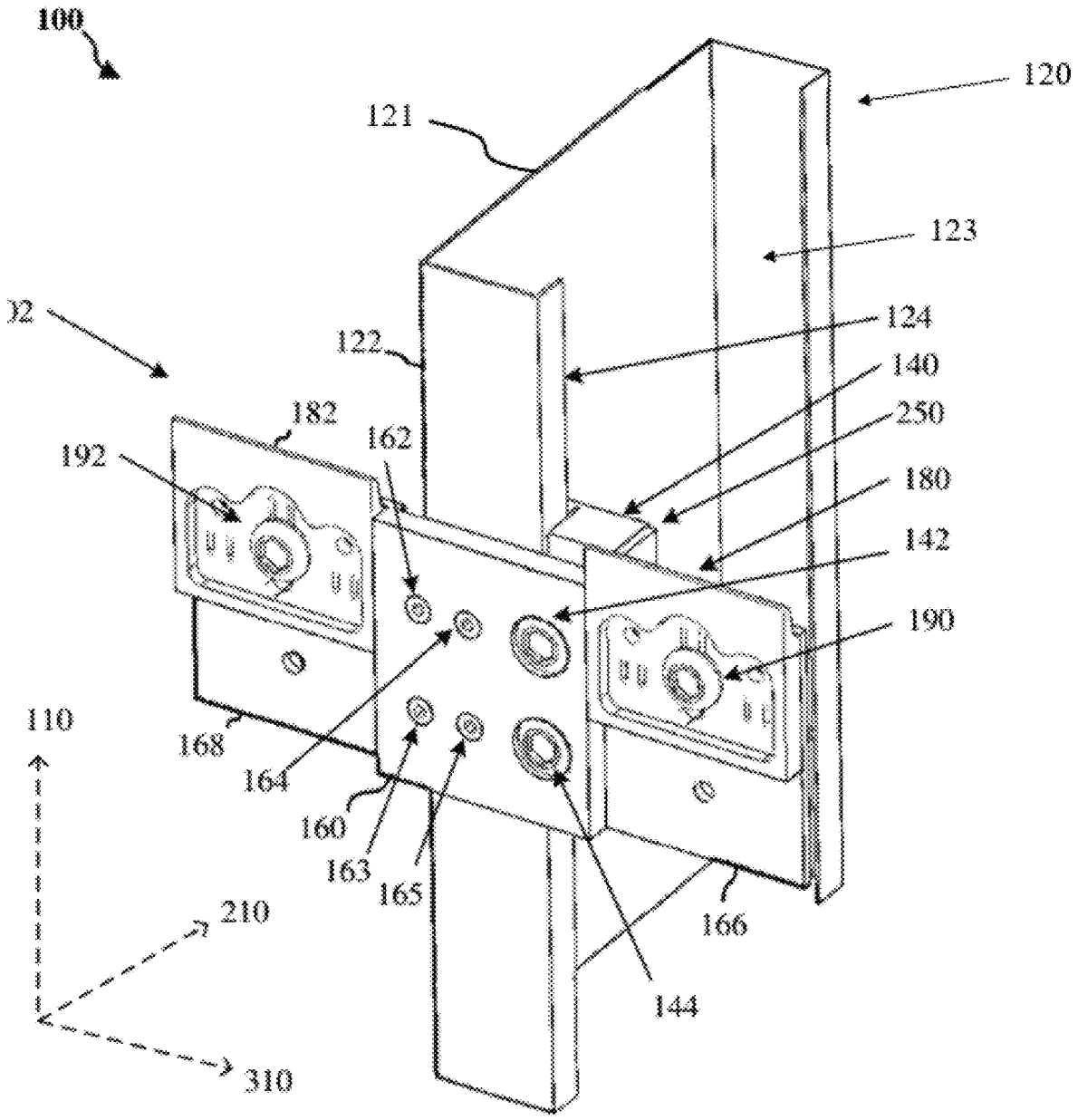
FIG. 1 is a front perspective view of a portion of an exemplary panel attachment system including an adjustable panel hanger attached to a support member.
Figure 2:
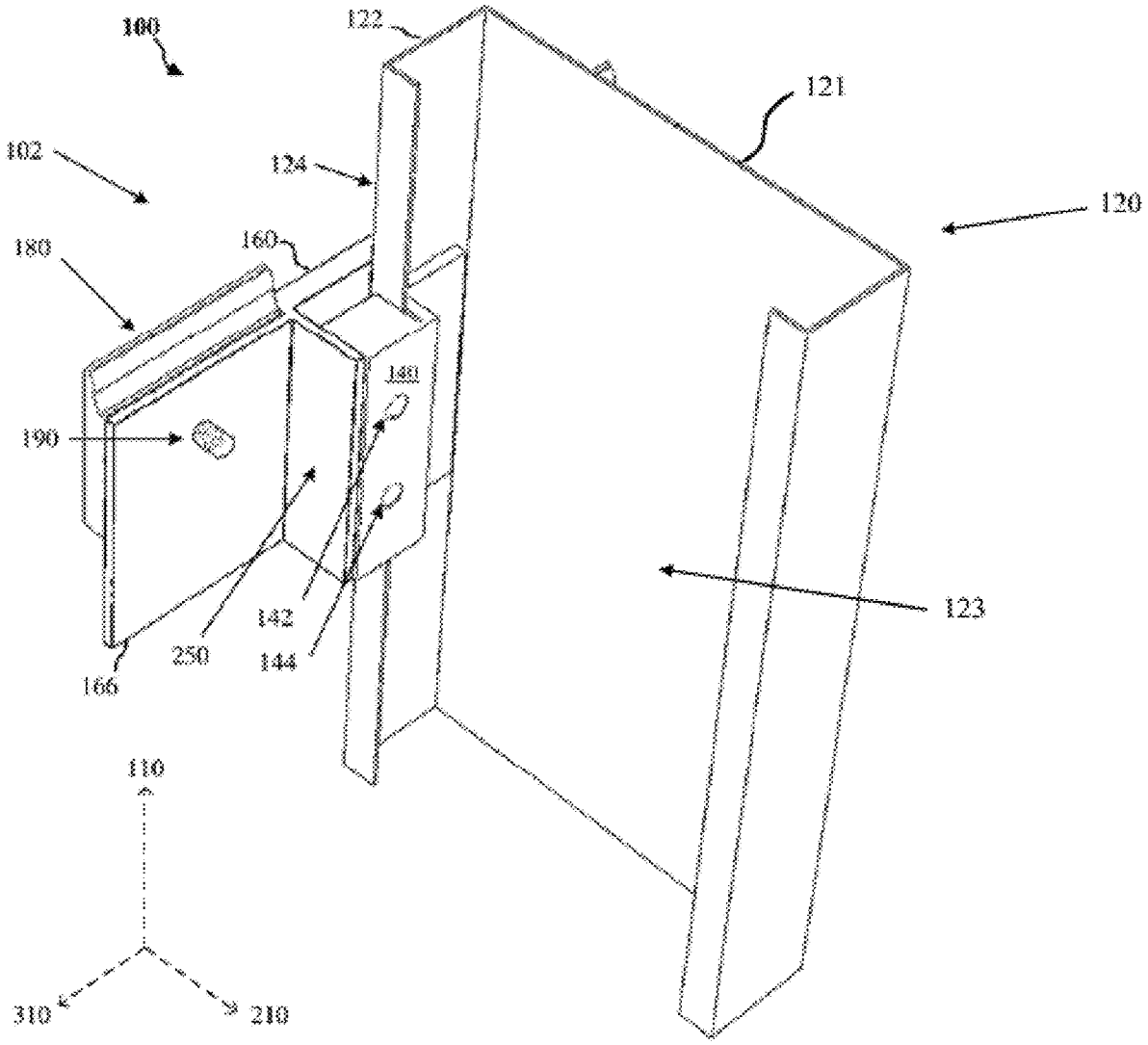
FIG. 2 is a rear perspective view of a portion of an exemplary panel attachment system including an adjustable panel hanger attached to a support member.

Accordingly, referring to FIGS. 1 and 2, a portion of an exemplary panel attachment system 100 includes an adjustable panel hanger 102 that may be easily and adjustably positioned on a support member 120, such as a vertical metal beam, for supporting a modular panel. The adjustable panel hanger 102 includes a connector member 140 configured to be removably fixed to the support member 120, a base member 160 configured to be adjustably fixed to the connector member 140, and at least one hanger member 180 configured to be adjustably fixed to the base member 160 to enable accurately mounting a modular panel.

The support member 120 has a body 121 and opposing support flanges 122 extending from each side, thereby forming a side opening 123. The support member 120 includes, for example, a vertical support structure, such as a vertical metal beam, I beam, or C beam. In an example embodiment the support member 120 may be an industry standard 20-gauge steel stud. The body of the support member 120 extends along a first axis 110, such as a y-axis, to define a height of the support member 120 and along a second axis 210, such as a z-axis to define a depth of the support member 120. Each support flange 122 extends perpendicularly away from the body of the support member 120 along a third axis 310, such as an x-axis. Also, each support flange 122 further includes an additional secondary support flange 124 that extends along the second axis 210, e.g., toward each other and toward a middle of the body of the support member 120. This secondary support flange 124 creates a U shape with the body of the support member 120. In other words, a horizontal cross-section through the support member 120 has a C-shape. In some scenarios, the support member 120 is made of a metal material.

The connector member 140 may be removably attached to a base member 160 in a manner configured to clamp on to the support flange 122 of the support member 120, enabling a position of the adjustable panel hanger 102 on the support member 120 to be easily fixed at any location along the first axis 110. For example, the connector member 140 includes a body that fits against one side of the support flange 122, with the base member 160 positioned on the other side, and affixing the base member 160 to the connector member 140 causes the arrangement to clamp onto the support flange 122. The base member 160 may be connected to the connector member 140 using one or more connector adjustment members 142 and 144, such as but not limited to screws, or screws and nuts. The connector adjustment members 142 and 144 adjust a distance between the base member 160 and the connector member 140 and thereby provide the clamping force to fix the base member 160 and the connector member 140 to the support member 120. In some examples, the base member 160 may include a through hole having a countersink or counter bore on a surface away from the connector member 140 to allow a structure of the connector adjustment member 142, 144, such as a screw head, to be flush or below the surface when installed. In some examples, the connector member 140 may include a threaded through hole aligned with the through hole in the base member 160 to enable engagement with threads of the connector adjustment member 142, 144, e.g., a screw. In other cases, the connector adjustment member 140 may have an unthreaded through hole, which allows a body of the connector adjustment member 142, 144 to pass through and engage with a retaining member, e.g., nut, of the connector adjustment member 142, 144 on side of the connector adjustment member 140 away from the base member 160.

Figure 8:
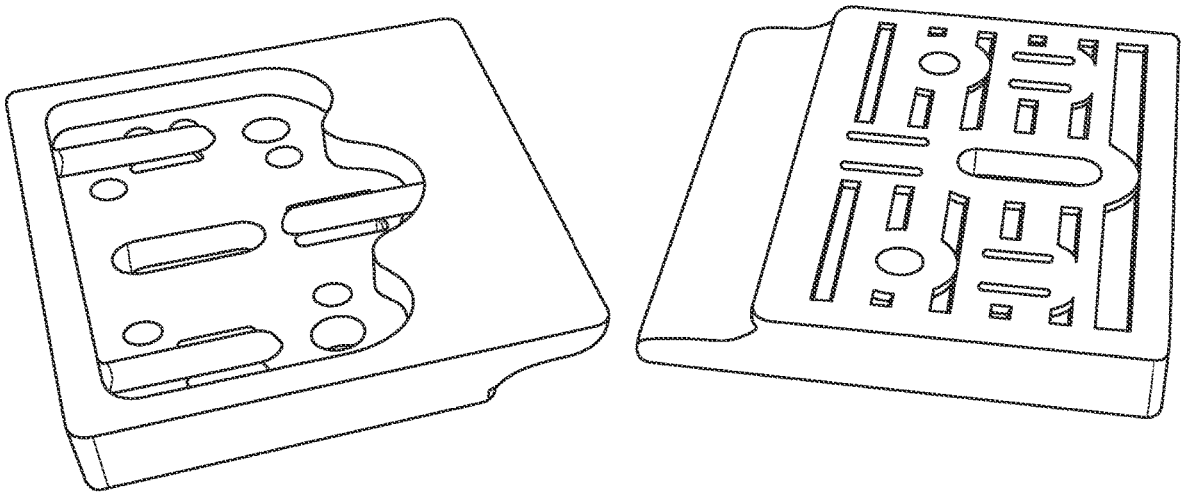
FIG. 8 is a front perspective of view of a hanger member and a panel connector member.

In some examples the base member 160 is movable relative to the support member 120 along the second axis 210 in order to enable an adjustment of a position of vertical face of a modular panel mounted on the adjustable hanger system 100 (see FIGS. 1, 2, and 8). For example, the base member 160 may have one or more base member adjustment members 162, 163, 164, and 165, which include any member that may change a relative distance between the base member 160 and the support member 120 along the second axis 210. Suitable examples of the one or more base member adjustment members 162, 163, 164, and 165 include a screw, a spacer, a washer, or any structure capable of maintaining a distance between the base member 160 and the support member 120. In some examples, only one base member adjustment member 162 is used. In FIGS. 1 and 2, four base member adjustment members 162, 163, 164, and 165 are used. The base member adjustment members 162, 163, 164, and 165 allow the base member 160 to move perpendicular to the adjacent face of the support flange 122. As such, the base member adjustment members 162, 163, 164, and 165 allow selective adjustment of the distance between the base member 160 and the adjacent face of the support flange 122. In some aspects, the connector adjustment members 142 and 144 and/or the base member adjustment members 162, 163, 164, and 165 can be cooperatively used to clamp the base member 160 and connector member 140 onto the support member 120. This allows a modular panel, when attached to the adjustable panel hanger 102, to be properly aligned.

Accordingly, referring to FIGS. 1-5, the base member 160 has at least one base flange 166 that extends away from a body of the base member 160 along the third axis 310, the third axis perpendicular to both the first axis 110 and the second axis 210 to provide a mounting surface for at least one hanger member 180 connectable to the base member 160. The at least one base flange 166 is connected to a side of the body of the base member 160 such that the front face of the at least one base flange 166 is spaced away from the front face of the body of the base member 160. For example, a first hanger member 180 and a second hanger member 182 may be respectively adjustably connected to a first base flange 166 and a second base flange 168 of the base member 160. Each of the first base flange 166 and the second base flange 168 extend on the third axis 310. Further the first hanger member 180 and second hanger member 182 have a thickness so as to be flush with the front face of the body of the base member 160 when attached to the respective base flanges 166, 168.

Figure 3:
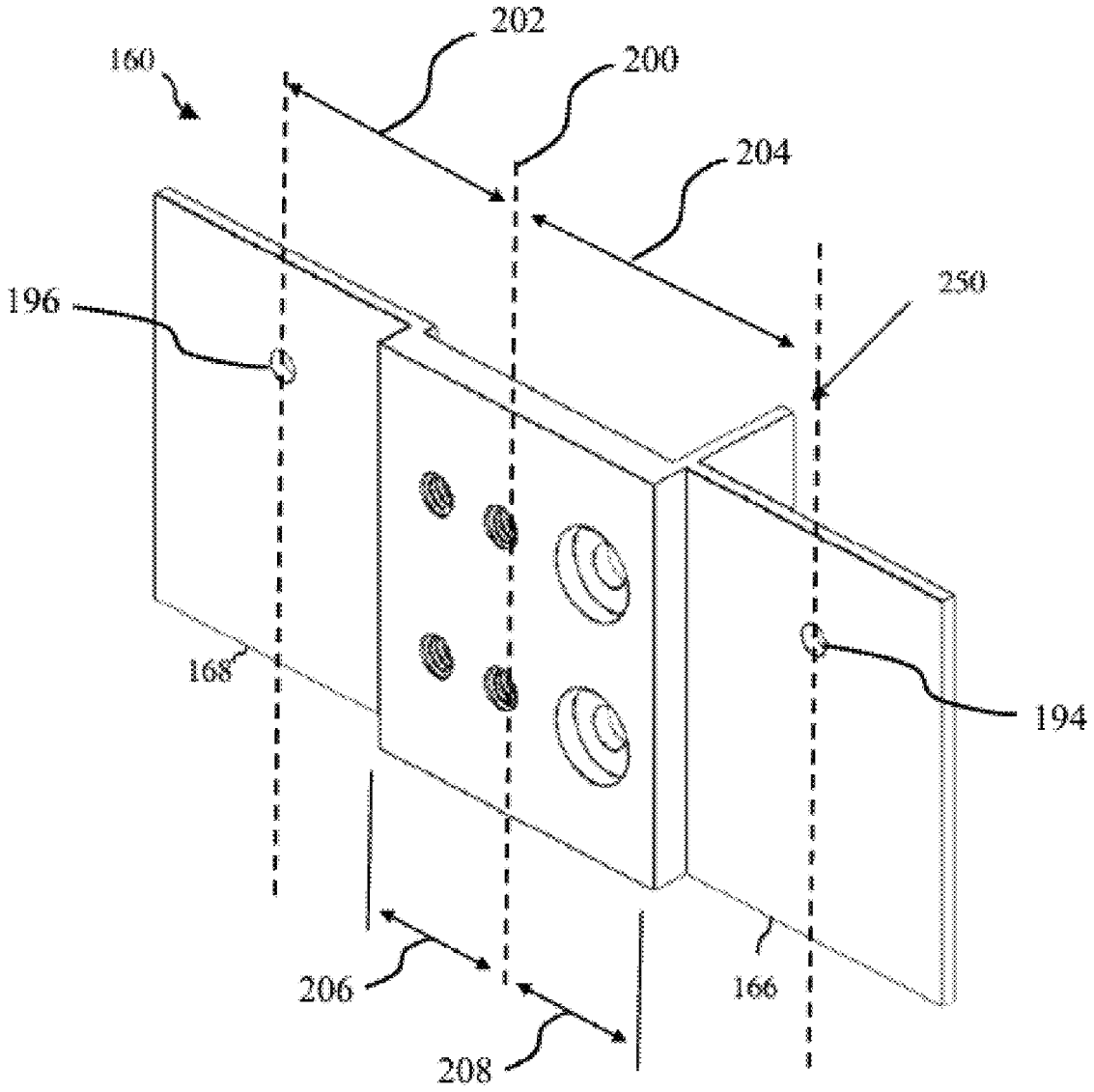
FIG. 3 is a front perspective view of a base member of the adjustable panel hanger, including a first and second base flange and a connector guide.

In an additional aspect as can be seen in FIG. 3, a first distance 206, 208 between a vertical center of the base member 200 and each of a first vertical edge and an opposing second vertical edge of a front surface of the base member 160 is equal. The base member 160 includes a first base flange 166 and a second base flange 168 each extending from opposing sides of the base member 160, wherein the first base flange 166 includes a first connecting member 194 and the second base flange 168 includes a second connecting member 196, and wherein a second distance 202, 204 between the vertical center of the base member and each of the first connecting member 194 and the second connecting member 196 is equal. This allows the base member 160 to be attached in any orientation, such as, either with the support member having the side opening facing to the right, as shown in FIG. 3, or to the left, simply by rotating the base member 180 degrees.

Further, each of the first hanger member 180 and second hanger member 182 are movable on the first axis 110 to enable, for example, a precise vertical positioning of the hanger members 180, 182, and hence a modular panel mounted thereto. For instance, in some examples, the hanger members 180, 182 may include an internal wall defining a slot extending along the first axis 110, and connecting members 190, 192, such as by not limited to a screw, may be engaged to corresponding connecting members 194, 196 (e.g., threaded holes; see FIG. 3) of the respective first or second base flange 166, 168 to adjustably fix the hanger members 180, 182 to the respective first or second base flange 166, 168. Accordingly, hanger members 180, 182 may be adjusted on the first axis 110 using the connecting members 190, 192. The hanger members 180, 182 comprise an insert portion on the front of the hanger (see FIG. 9). The indent allows connecting member 190, 192 to screw in, but head of the connecting member 190, 192 to insert into the hanger member 180, 182. In an alternative implementation a nutsert may be used as the connecting member 190, 192. This insert design allows the hanger member 180, 182 to fit against a modular panel 520 (see FIGS. 9 and 11).

Thus, the panel attachment system 100 provides a quick and easily installed system that can be affixed to a standard building support structure 120, and that can be quickly and easily adjusted vertically and relative to a face of the support structure 120 in order to accurately position a modular panel mounted on the adjustable panel hanger 102. The components of the adjustable panel hanger 102 may be made a variety of materials including nylon, plastic, metal, aluminum, etc.

Figure 5:
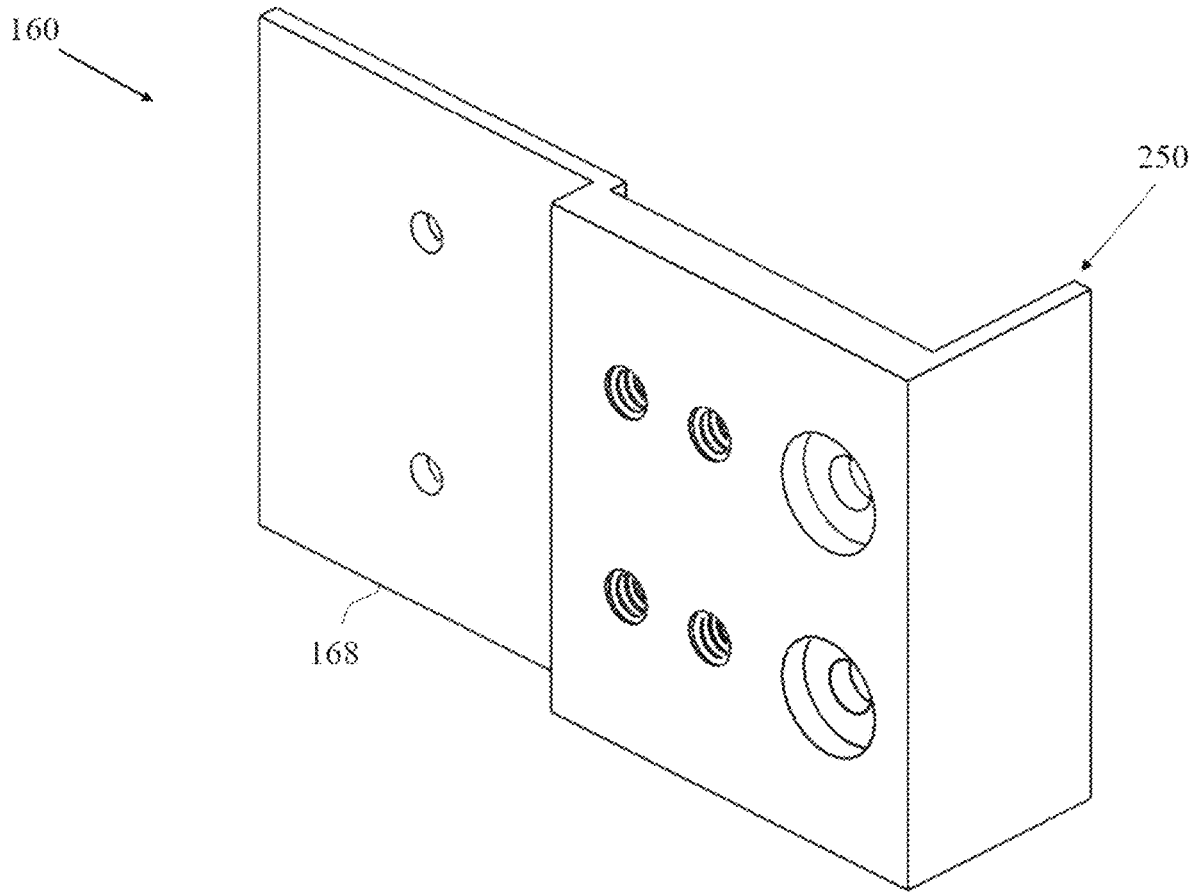
FIG. 5 is a front perspective view of a base member of the adjustable panel hanger, including only one base flange.

In an alternative aspect, as can be seen in FIG. 5, the panel attachment system 100 may only require one of the first base flange 166 or second base flange 168. For example if only one panel is required, the panel attachment system 100 may only include the first base flange 166 with the second base flange 168 being removed, or alternatively the panel attachment system 100 may only include the second base flange 168 with the first base flange 166 being removed. This alternative aspect allows for a single panel or a single row of panels to be added to a corner section of a wall of panels or at the end of a wall of panels, and is attached using the same mechanism as a panel attachment system 100 with both the first base flange 166 and the second base flange 168.

Figure 6:
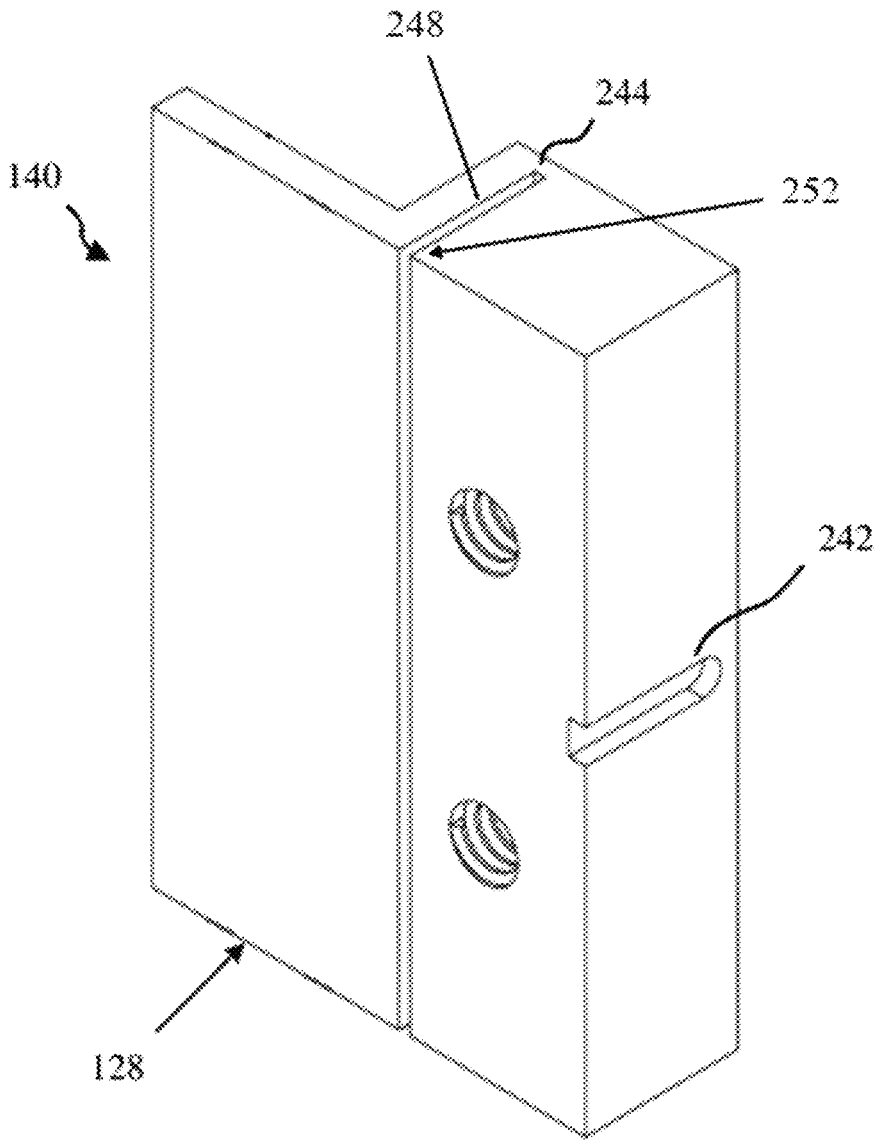
FIG. 6 is a front perspective view of a connector member of the adjustable panel hanger, including a connector notch and a connector channel.
Figure 7:
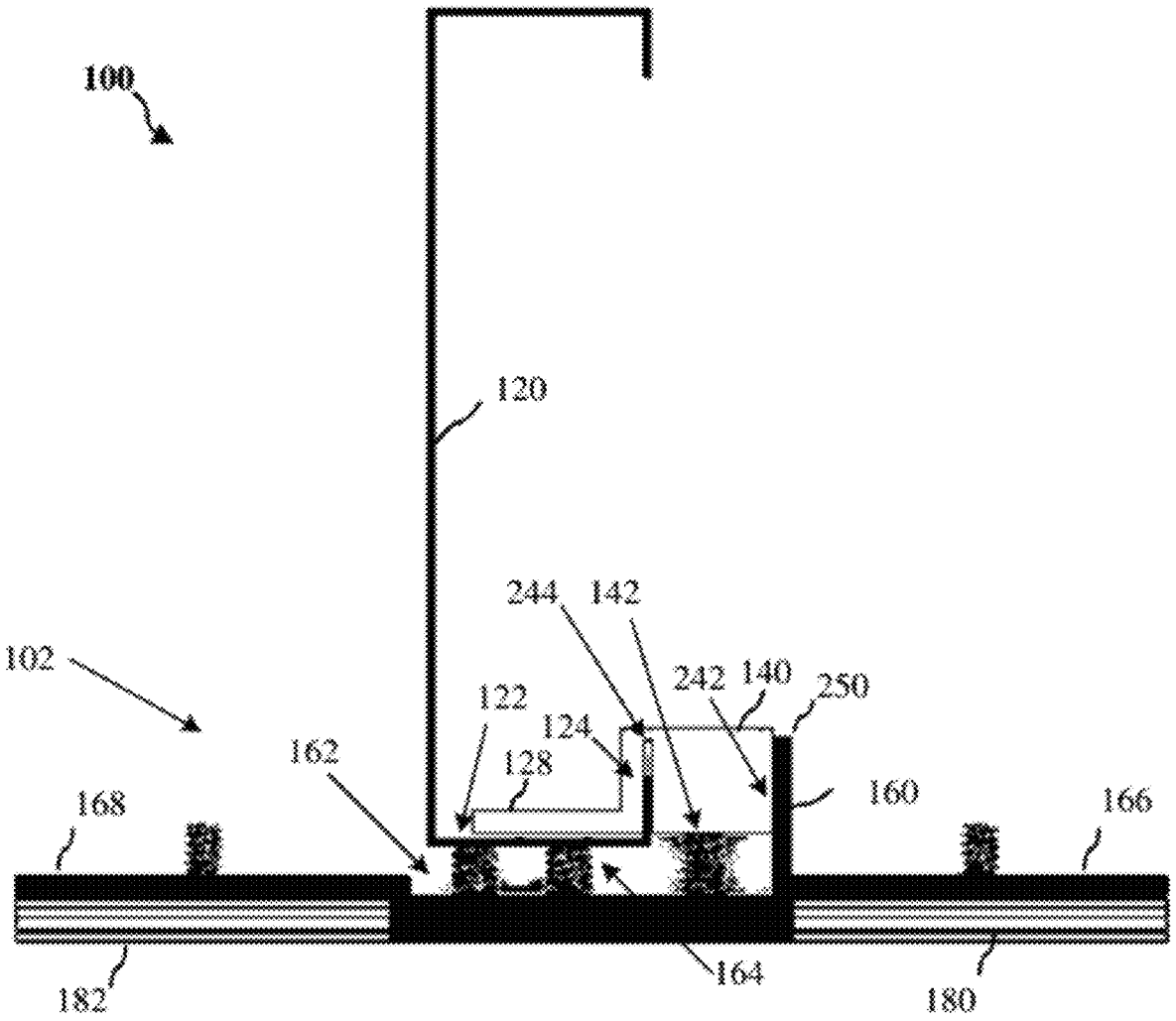
FIG. 7 is a top-down view of the example adjustable panel hanger attached to the support member of FIG. 1.

Referring to FIGS. 6 and 7, in some aspects, the connector member 140 includes a connector channel 244 that forms an opening 252 sized to enable the connector member 140 to fit over the secondary support flange 124 so that the connector member 140 can engage an interior surface of the support flange 122. The connector channel 244 further includes a plurality of inner walls 248, which are spaced apart an amount configured to receive the secondary support flange 124. In an aspect, the spacing between the inner walls 248 of the connector channel 244 are sized to allow the secondary support flange 124 to securely fit into the connector channel 244 thereby allowing minimal movement of the connector member 140. For example, the connector channel 244 extends a length of the connector member 140, and includes open top and bottom ends, thereby enabling the secondary support flange 124 of the support member 120 to fit into the connector channel 244. Accordingly, in some aspects, the connecting member 140 may also include a connector flange 128 extending on the third axis 310. The connector flange 128 may fit against the interior surface of the secondary support flange 124. In an aspect, the connector channel 244 and connector flange 128 are arranged as to allow the connector member 140 to be flush with the support member 120, and specifically with at least the inside surfaces of the support flange 122 and the secondary support flange 124. The connector member 140 clamps onto the support member 120 by adjusting the base member adjustment members 162, 163, 164, 165 and connector adjustment member 142, 144. A spacer may be used between the connector member and the interior surface of the secondary support flange 124.

Additionally, in some aspects, the connector member 140 may include a connector guide 242 for locating and/or movably connecting the connector member 140 with a corresponding guide member extending from or through the base member 160. The connector guide 242 can be a notch (as illustrated) on a side of the connector member 140 or hole within a body of the connector member 140.

The connector guide 242 may allow for a more efficient and simple installation of the adjustable panel hanger 102. For example, the base member 160 may be configured to receive a pin that extends into the connector guide 242 (e.g., in the form of a hole), or may be configured to include a base extension that extends into the connector guide 242 (e.g., in the form of a notch). As such, the connector guide 242 works as a guiding structure to align the connector member 140 with the base member 160, so that the connector adjustment members 142 and 144 are more easily installed.

Additionally, in some aspects, the base member 160 may include a connector flange 250 that extends perpendicular from the body of the base member 160 along the second axis 210. The connector flange 250 fits against the side of the connector member 140. The connector flange 250 allows for the connector member 140 and the base member 160 to more easily be installed. The connector flange 250 may also include a complementary notch to the connector guide 242. The complementary notch on the connector flange 250 may protrude along the second axis 210. The connector guide 242 is configured to fit into the complementary notch of the connector flange 250. As mentioned above, in some aspects the connector flange 250 is a in the form of a pin that extends into the connector guide 242 (e.g., in the form of a hole). Accordingly, the pin may extend along the second axis 210. The pin may also be removably attached to the base member 160.

Figure 4A:
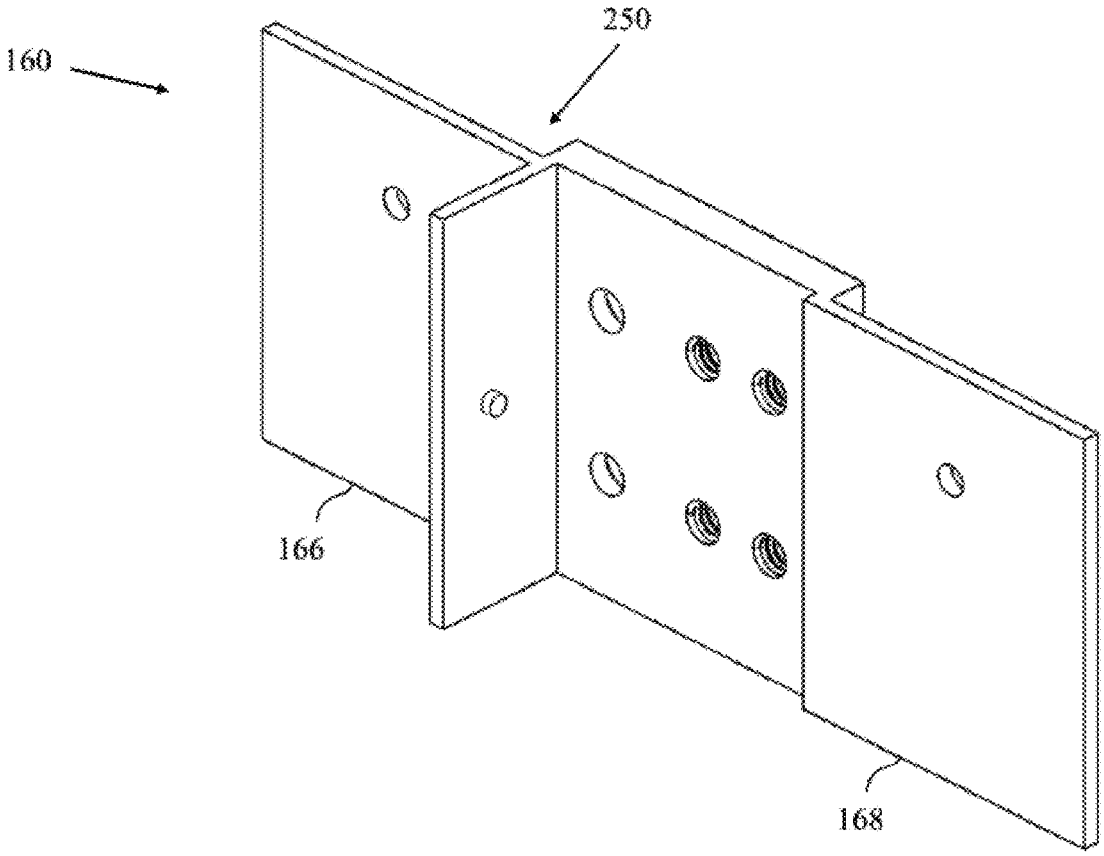
FIG. 4A is a back perspective view of the base member of FIG. 3.
Figure 4B:
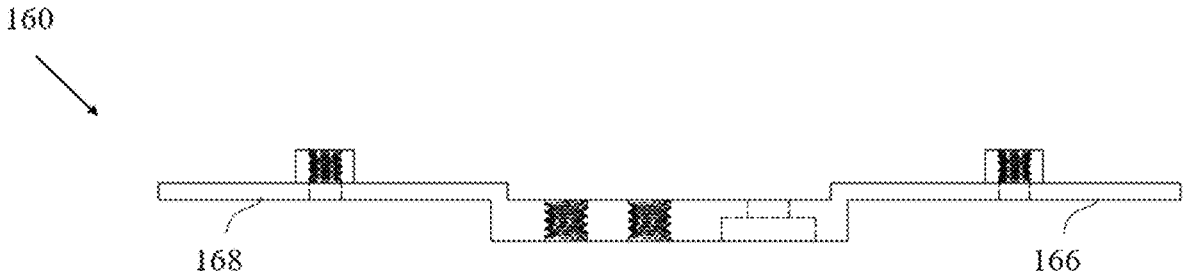
FIG. 4B is a top view of the base member of FIG. 3

Additionally, in an alternative aspect, the connector member 140 may have a gripping structure on the surface of the connector member 140 in contact with the support member 120 (see FIG. 5). The gripping structure may include, but is not limited to, teeth (as illustrated in FIG. 4), a foam, rubber, or elastic pad, an adhesive, or a rough surface. The gripping structure may allow the connector member 140 to grip more tightly onto the support member 120 and/or may provide for additional biasing force. The connector member 140 may be made of a variety of materials including nylon, plastic, metal, aluminum, etc.

Figure 9:
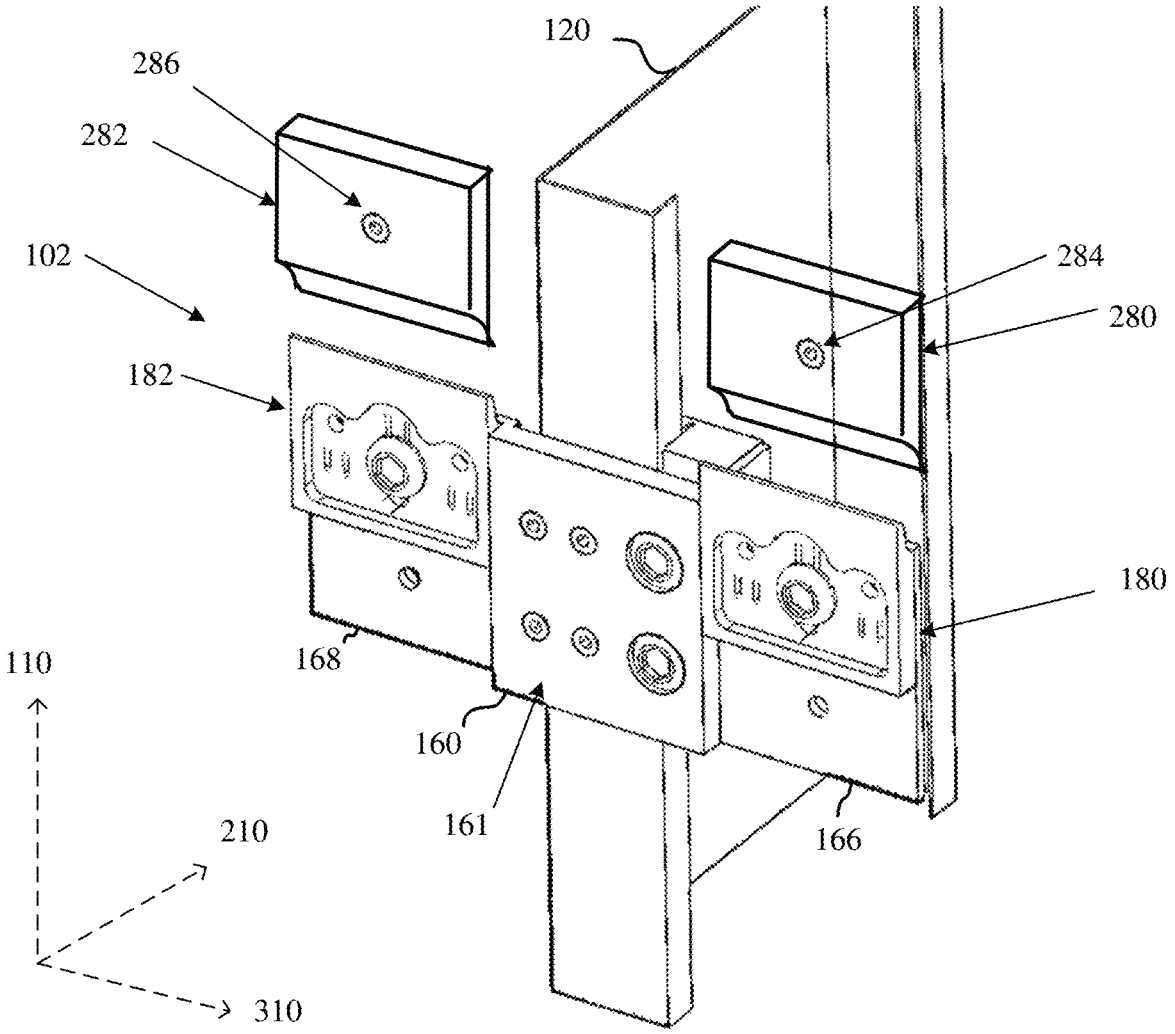
FIG. 9 is a front perspective view of an exemplary panel attachment system including a panel connector member attaching to a hanger member.
Figure 11:
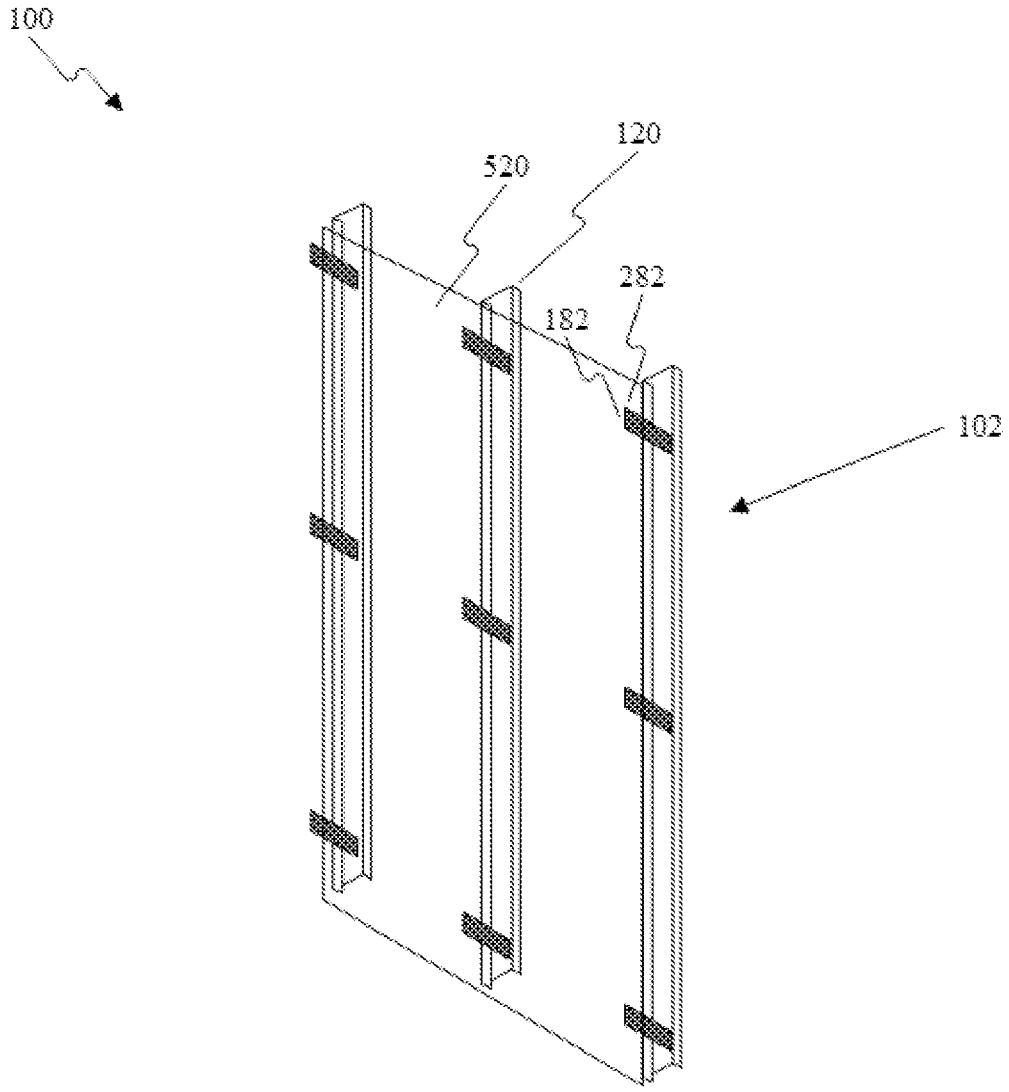
FIG. 11 is a front perspective view of another aspect of the exemplary panel attachment system of FIG. 1 including a modular panel attached to a plurality of adjustable panel hangers, which are affixed to a plurality of support members, thereby forming a wall.
Figure 12:
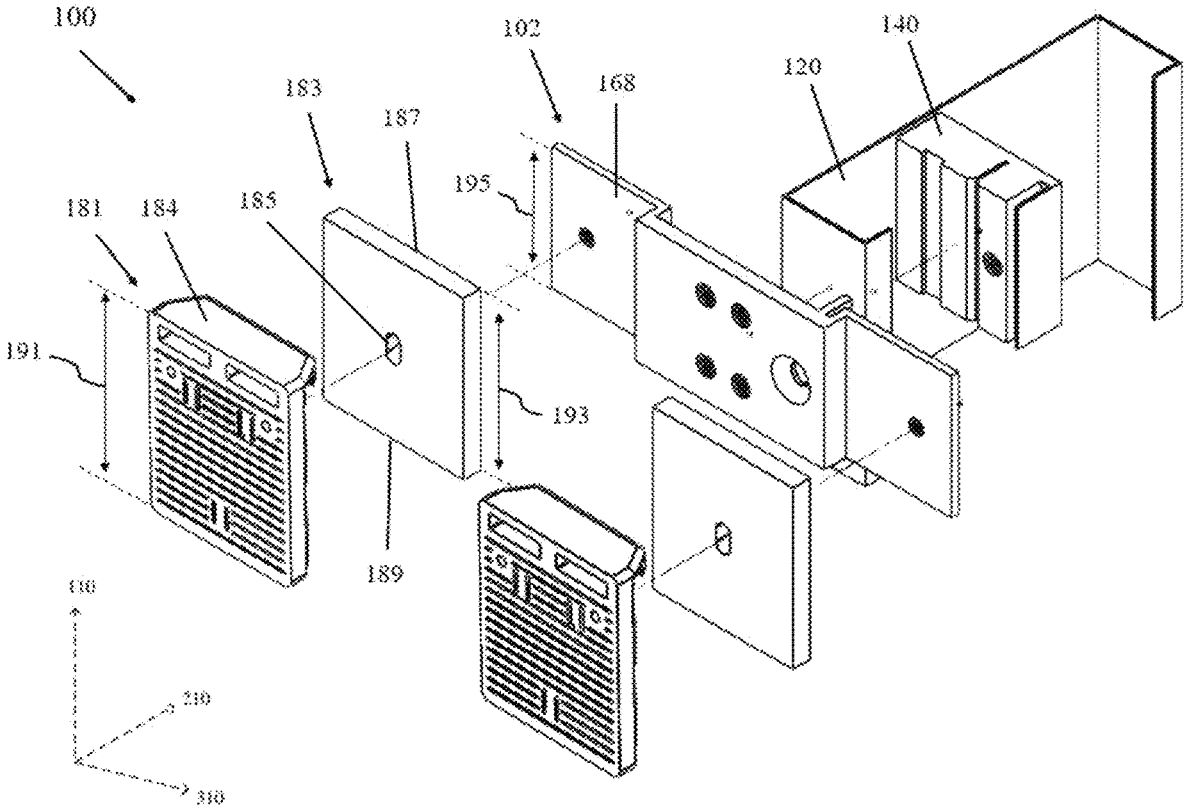
FIG. 12 is an exploded front perspective view of an exemplary panel attachment system.

Referring to FIGS. 8 and 9, in some aspects, each of the hanger members 180, 182 are each configured to receive, an enable attachment of, a corresponding panel connector member, such as panel hook members 280, 282, that is fixed to a back surface of at least one respective modular panel (see modular panel 520 of FIG. 11). The hanger members 180, 182 are attached each of the first flange 166 and/or second flange 168 of the base member 160. The panel hook members 280, 282 are attached to the modular panel 520 (see FIG. 11). The panel hook members 280, 282 hook onto each of the hanger members 180, 182 to hold the modular panel 520 to the support member 120 (see FIG. 11) to thereby form a wall or part of a wall. This allows for the modular panel 520 to be easily installed and adjusted. The panel hook members 280, 282, may be attached to a modular panel 520 panel by one or more connector members 284, 282. The panel connector member 280, 282 may be a screw, staple, bolt, or any other form of a mechanical or chemical (e.g., adhesive) attachment. The panel hook members 280, 282 are configured for the modular panel 520 to fit against the front surface of the panel hook members 280, 282. The hanger members 180, 182 and panel hook members 280, 282 may be made of a variety of materials including nylon, plastic, metal, aluminum, etc. In some aspects, the hangar members 180, 182 are attached each of the first flange 166 and/or second flange 168 of the base member 160 by an adhesive, glue, or other chemical fastener (rather than a mechanical fastener such as a screw or bolt).

Additionally, in some aspects, referring specifically to FIGS. 1 and 9, the base member 160 may have three body portions, a center body portion 161, a first flange 166, and a second flange 168. The center body portion 161 having an support facing wall and an internal wall. The support facing wall of the center body portion 161 is configured and arranged to interface with the support member 120. The center body portion 161 and the support member 120 may be in contact directly with each other or indirectly via some form of a spacer or one or more of the base member adjustment members 162, 163, 164, 165. For example, a spacer piece may separate the center body portion 161 from the support member. Additionally, the center body portion 161 may include an internal wall defining one or more through holes to configured to receive the base member adjustment members 162, 163, 164, 165 and the connector adjustment members 142 and 144. The connector adjustment members 142 and 144 are configured to adjust the spacing between the support member 120 and the body member 160 so that they clamp onto the support member 120. Accordingly, the connector adjustment members 142, 144 are configured to move the body member 160 on the second axis 210.

Figure 10:
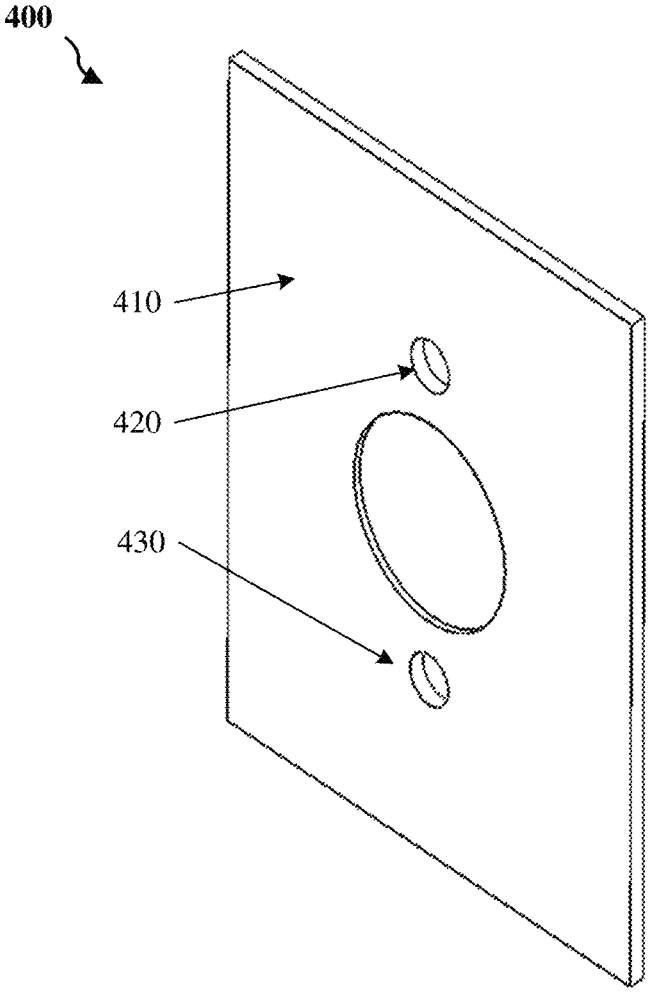
FIG. 10 is a front perspective view of a magnetic attachment member connectable to the adjustable panel hanger of FIG. 1, for connecting to a modular panel.

Referring to FIG. 10, in some aspects, instead of or in addition to including a hanger member 180 and/or 182, the adjustable panel hanger 102 may include a magnetic attachment member 400 configured to be magnetically attracted to a corresponding attachment member on a modular panel to help hold the modular panel in place. For example, a modular panel may have a mount that engages a hanger member 180 of a first adjustable panel hanger 102 toward a top end of the modular panel, while attachment members at a middle and a bottom of the modular panel may magnetically couple with respective magnetic attachment members 400 of respective second and third adjustable panel hangers 102. The magnetic attachment member 400 connects to the base member 160 in a similar manner as the hanger member 180, and thus may include at least one internal wall 410 defining a through hole 420 to receive a connecting member 190, such as but not limited to a screw or a nutsert. The magnetic attachment member 400 may connect to a first flange 166 and/or a second flange 168 of the base member 160. The magnetic attachment member 400 can be used to further secure the modular panel to wall while allowing for large tolerances in the positioning of the corresponding attachment members on the modular panel. The magnetic attachment member 400 may include a magnet or a ferromagnetic material (e.g. steel). The magnetic attachment member 400 consists of one or more holes 420, 430 to attach to the first flange 166 and/or the second flange 168 of the base member 160.

Referring to FIG. 11, the panel attachment system 100 includes a plurality of adjustable panel hangers 102 installed on a plurality of support members 120, and a modular panel 520 mounted on the plurality of adjustable panel hangers 102. For example, the panel attachment system 100 may include a plurality of adjustable panel hangers 102 configured to attach to the support members 120 and connect to corresponding attachment mechanisms on at least a top of a modular panel 520. In some aspects, the adjustable panel hangers 102 are configured to attach to the modular panel 520 using the hanger members 180, 182 (see FIG. 9) and/or magnetic attachments (see FIG. 11). Accordingly, as seen in FIG. 11, there may be one row at the top of modular panel 520 configured to attach the modular panel 520 to the support member 120 using a hanger members 180, 182. Also, in some cases, a second and/or third row of adjustable panel hangers 102, in this example below the top row, may alternatively include the magnetic attachment member 400 is configured to magnetically attach or at least attract the support member 120 to a corresponding ferromagnetic member, or a magnet of having an opposite pole, on the modular panel 520. More specifically, the hanger members 180, 182 of the adjustable panel hangers 102 are configured to attach to a corresponding panel hook member 280, 282 on a back side of the modular panel 520. Further, it should be noted that the left or right edge of the modular panel 520 may only connect to one of the hanger members 180 or 182 of the corresponding adjustable panel hanger 102. This allows for the modular panel 520 to only attach to a portion of the adjustable panel hanger 102, therefore allowing and additional modular panel 520 to attach to the same adjustable panel hanger 102. In other words, adjacent modular panels 520 may be aligned along a vertical axis that corresponds with a vertical axis of the support member 120. The panel attachment system 100 may include one or more filler members, such as an elongate elastic material (e.g., rubber, foam) to fill any spaces between any adjacent modular panels 520. Thus, the present solution provides an efficient an inexpensive mechanism for hanging modular panels.

Referring to FIGS. 12-17, in an alternative or additional aspect, the panel attachment system 100 may include at least one panel connector member 181 configured to clip onto and/or otherwise engage a corresponding panel hanger member 183, where the base member 102 includes at least one flange 168. The panel connector member 181 may also be referred to as a clip or a C-clip. The panel hanger member 183 may be similar to the first and/or second hanger members 180, 182 (see, e.g., FIG. 9) and the panel connector member 181 may be similar to the first and/or second panel hook members 280, 282 (see, e.g., FIG. 9), however, the panel hanger member 183 and the panel connector member 181 are configured to allow the panel connector member 181 to be releasably engageable along at least two edges of the panel hanger member 183. This configuration allows a panel, which is connected to the panel connector member 181, to be more securely connected to the panel attachment system 100, as the structure of the panel connector member 181 limits movement of the panel relative to the panel attachment system 100 in at least two different directions. Additionally, although not illustrated, it should be understood that the panel attachment system 100 of FIGS. 12-17 may include one or more connector adjustment members and/or one or more a base member adjustment member, such as described above with respect to FIGS. 1-11.

In one example, for instance, the panel connector member 181 has a top hook member 184 and a bottom flange member 186 (see, e.g., FIG. 13) configured to allow the panel connector member 181 to releasably engage along both a top edge 187 and a bottom edge 189 of the panel hanger member 183. Further, for instance, the panel connector member 181 has a height 191 along first axis 110 greater than a height 193 of the corresponding panel hanger member 183 in order to allow the top hook member 184 and the bottom flange member 186 to fit over the panel hanger member 183. In some optional aspects, the height 193 of the panel hanger member 183 may also be greater than a height 195 of the corresponding base flange 168, which provides clearance for the top hook member 184 and/or the bottom flange member 186 to be fit around the panel hanger member 183 without interfering with the base flange 168.

In other words, the panel connector member 181 may be substantially similar to panel hook members 280, 282 (see, e.g., FIG. 9), but includes additional structure that allows the panel connector member 181 to resist detachment from the panel hanger member 183.

The at least one panel hanger member 183 may include an inner wall defining a slot sized and shape to receive a connecting member, e.g., similar to connecting member 190 but with a head sized to fit within the slot, which allows the panel hanger member 183 to be adjustably fixed to the corresponding base flange, e.g., base flange 168, of the base member 102. This adjustability enables accurately mounting a modular panel at a specified height relative to the support member 120.

Figure 13:
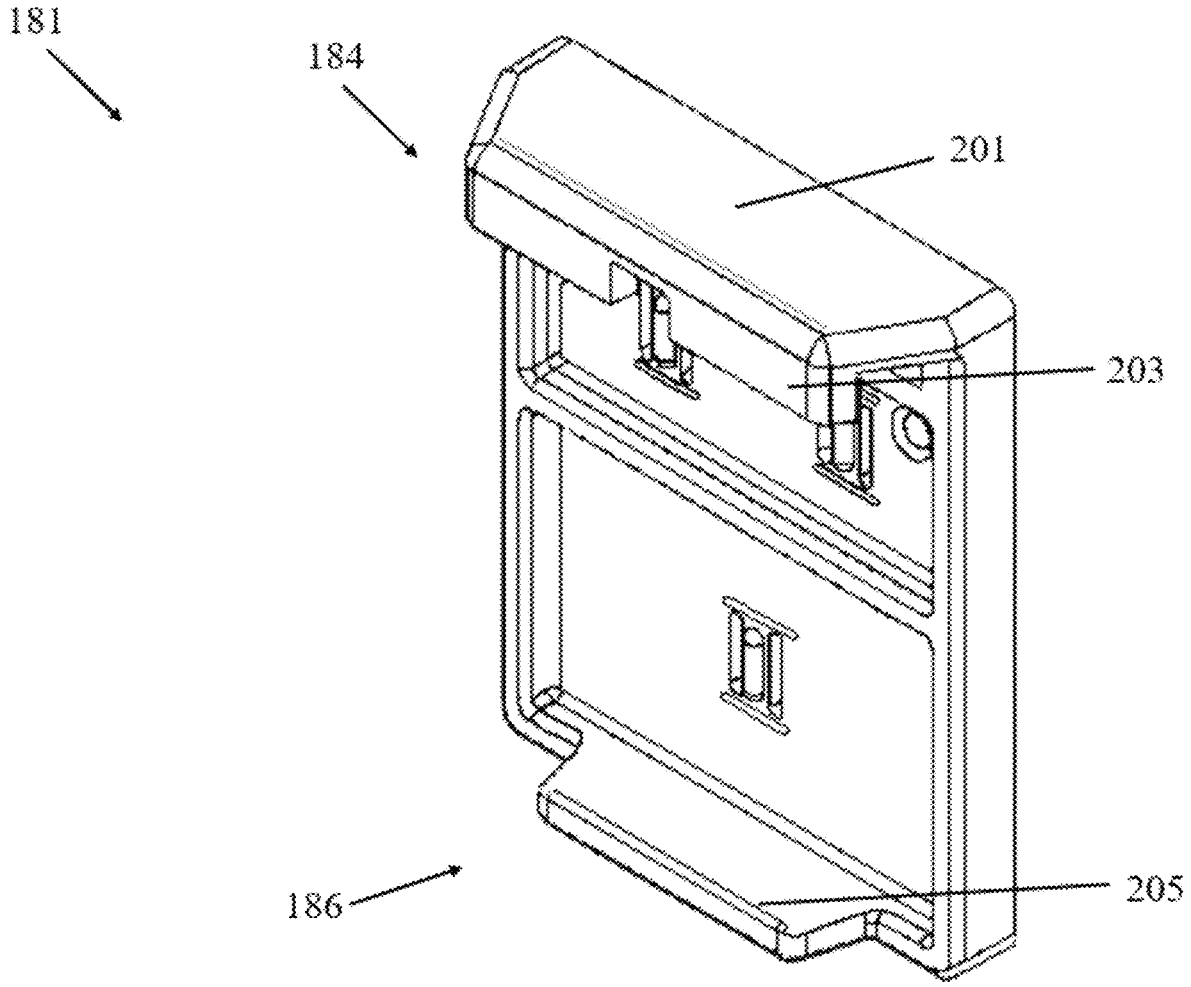
FIG. 13 is a front perspective view of the panel connector member of FIG. 12.
Figure 14A:
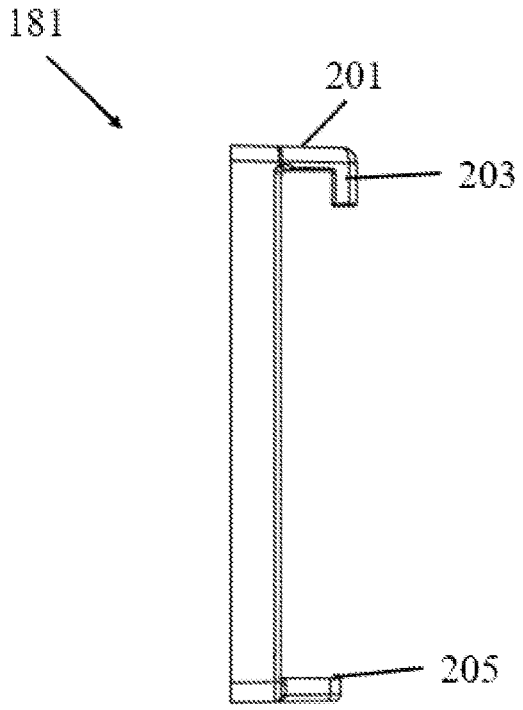
FIG. 14A is a left side view of the panel connector member of FIG. 12 (the right side view is a mirror image).
Figure 15:
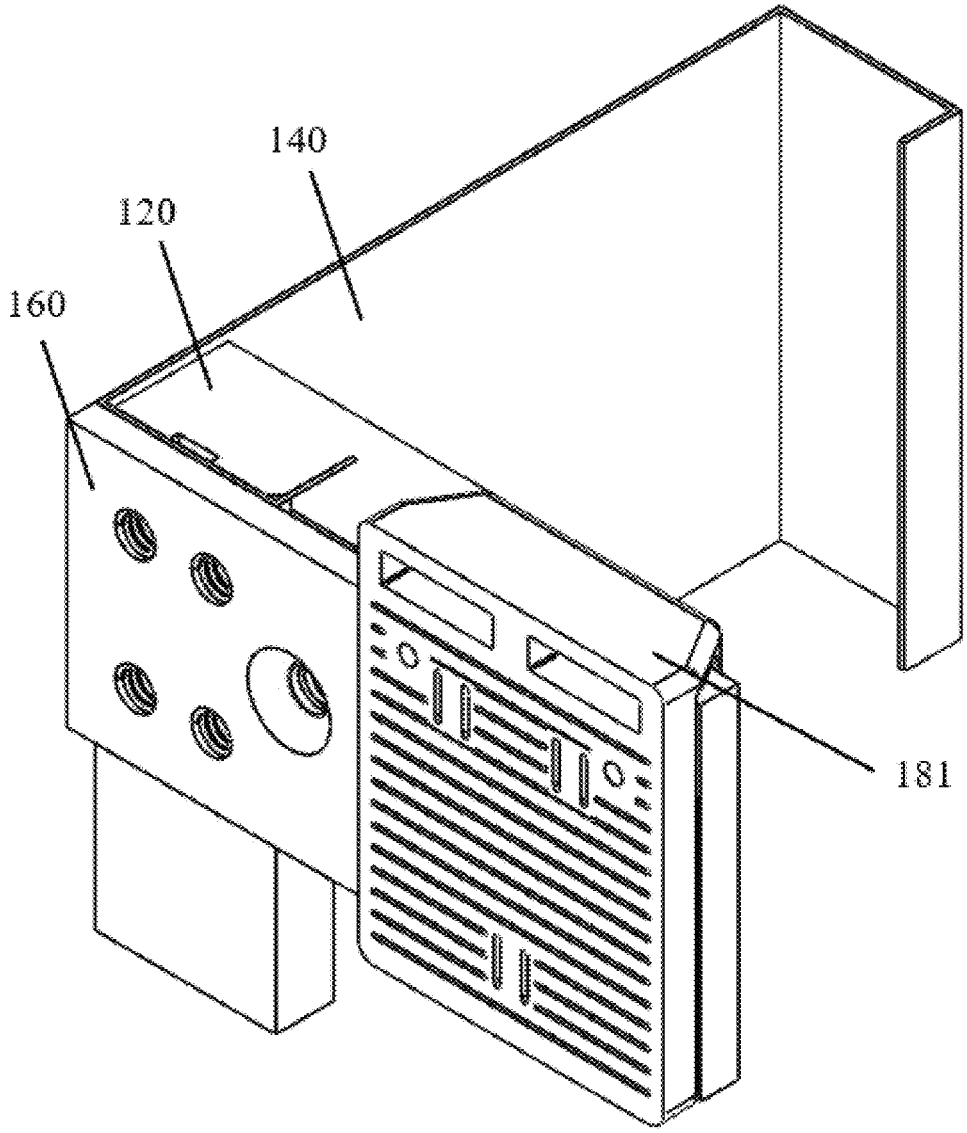
FIG. 15 is a front perspective view of a portion of an exemplary single wing panel attachment system including an adjustable panel hanger attached to a support member.
Figure 16:
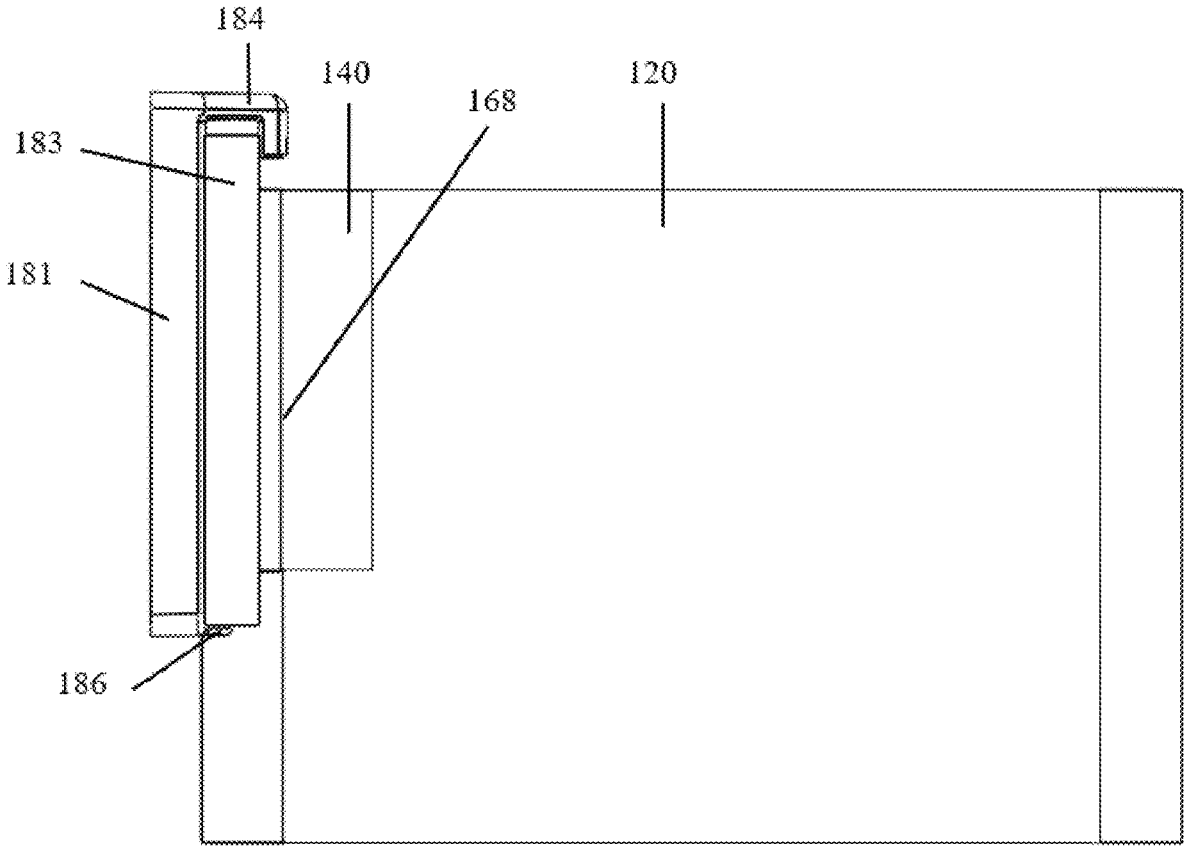
FIG. 16 is a side view of a portion of an exemplary single wing panel attachment system including an adjustable panel hanger attached to a support member.
Figure 17:
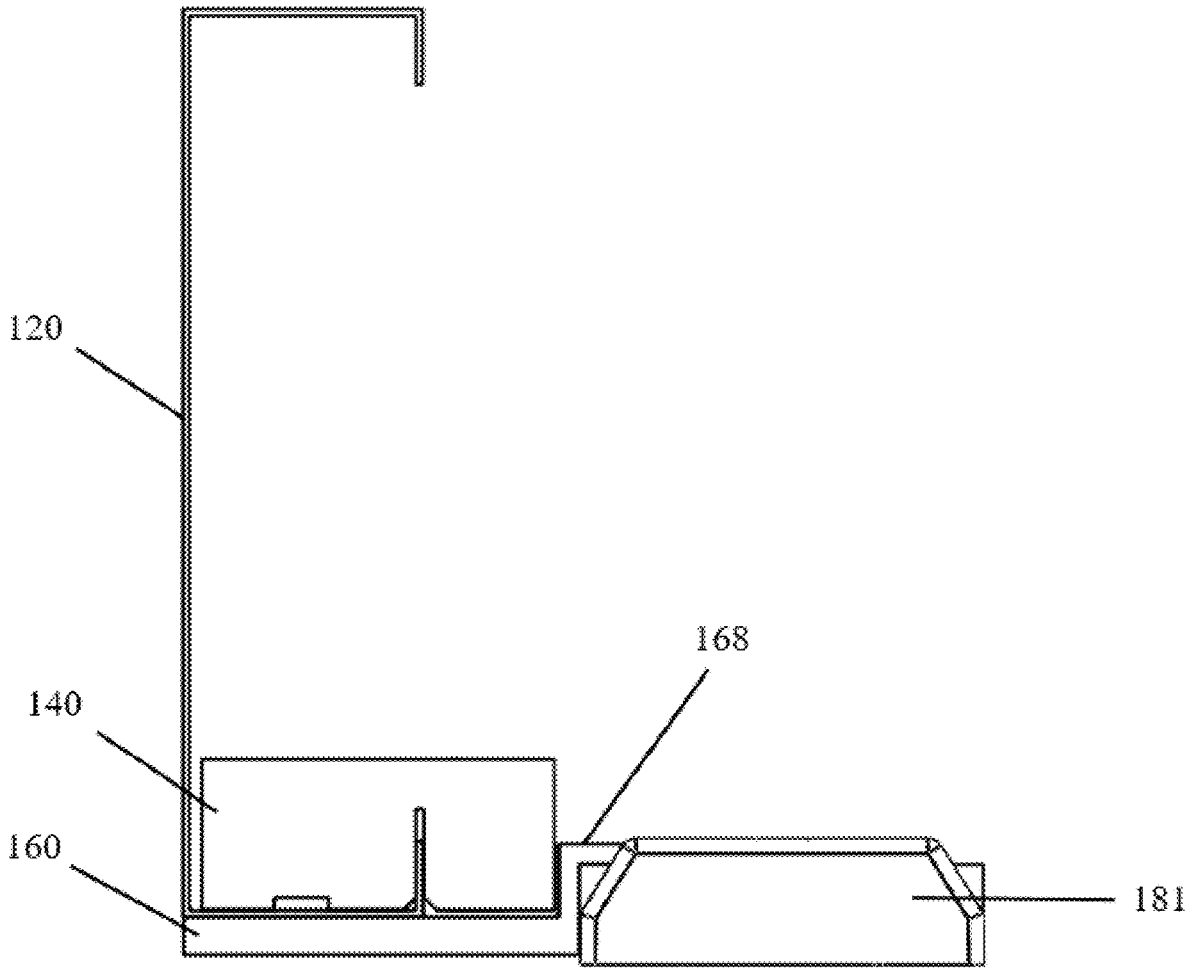
FIG. 17 is a top view of a portion of an exemplary single wing panel attachment system including an adjustable panel hanger attached to a support member.
Figure 18A:
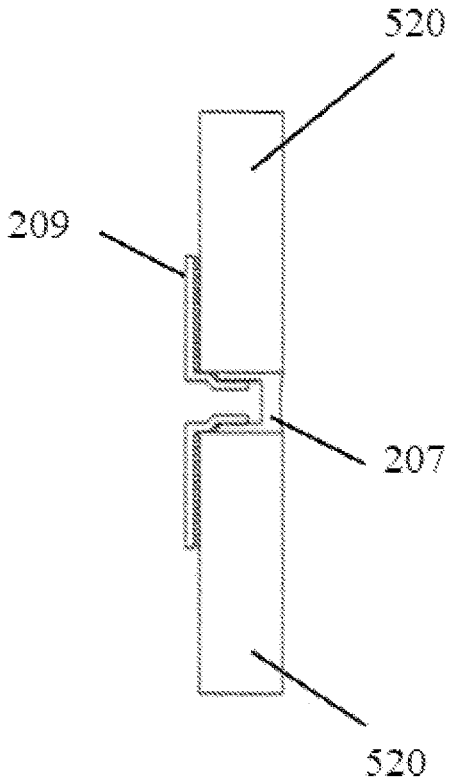
FIG. 18A is a left side view of respective portions of adjacent modular panels, mountable to a support member by the adjustable panel hanger of FIG. 1, and a panel gap filler mechanism connected to respective panel filler connection members.
Figure 18B:
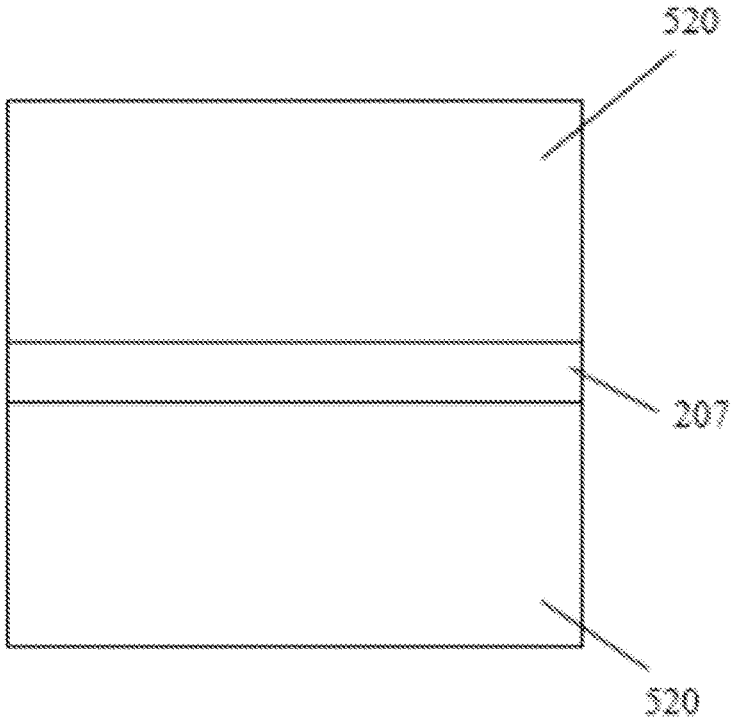
FIG. 18B is a front view of the respective portions of the adjacent panels and the panel gap filler mechanism.
Figure 19A:
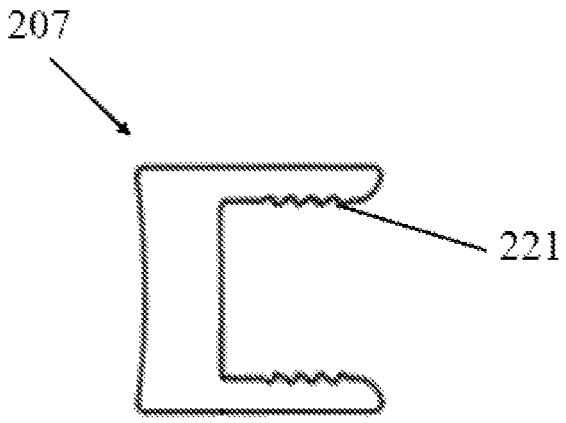
FIG. 19A is a right side view of the panel gap filler of FIGS. 18A and 18B (the left side view being a mirror image).
Figure 19B:
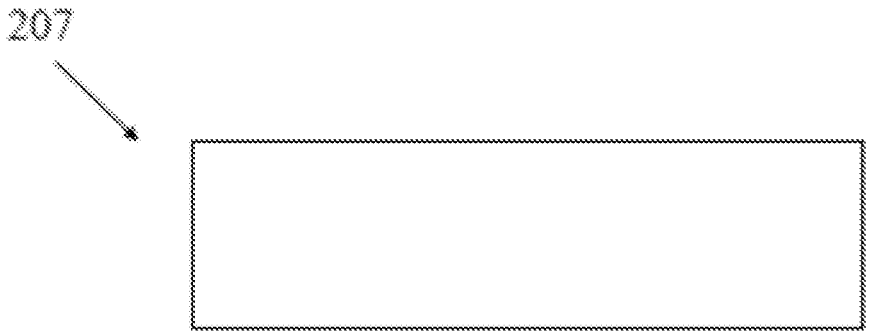
FIG. 19B is a top view of the panel gap filler (the bottom view being a mirror image, and the front view being the same).
Figure 19C:
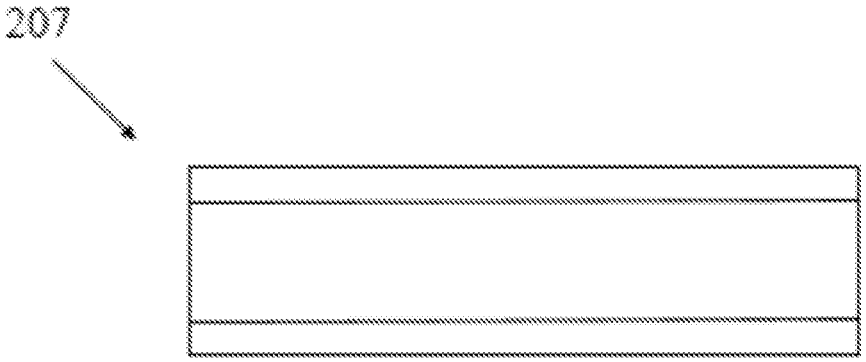
FIG. 19C is a back view of the panel gap filler.
Figure 20A:
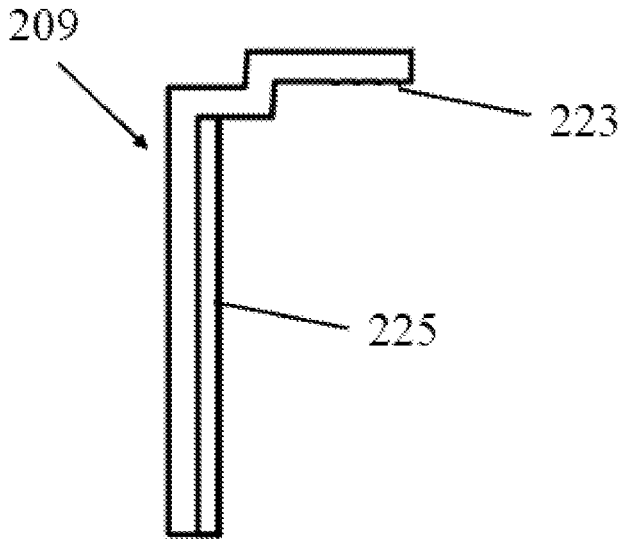
FIG. 20A is a left side view of the bottom one of the panel filler connection members of FIGS. 18A and 18B (the right side view is a mirror image).
Figure 20B:
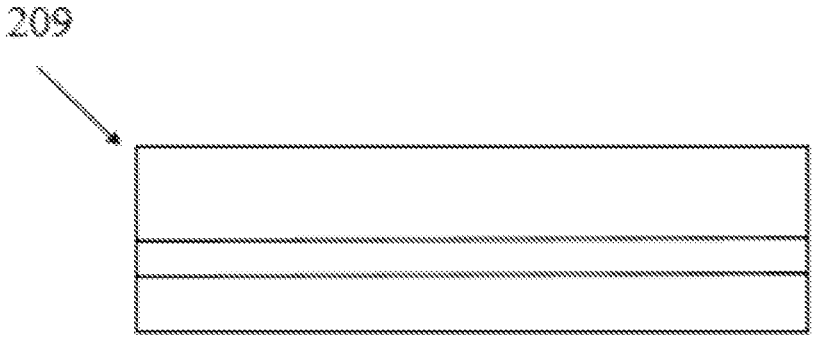
FIG. 20B is a top view of the panel filler connection member.
Figure 20C:
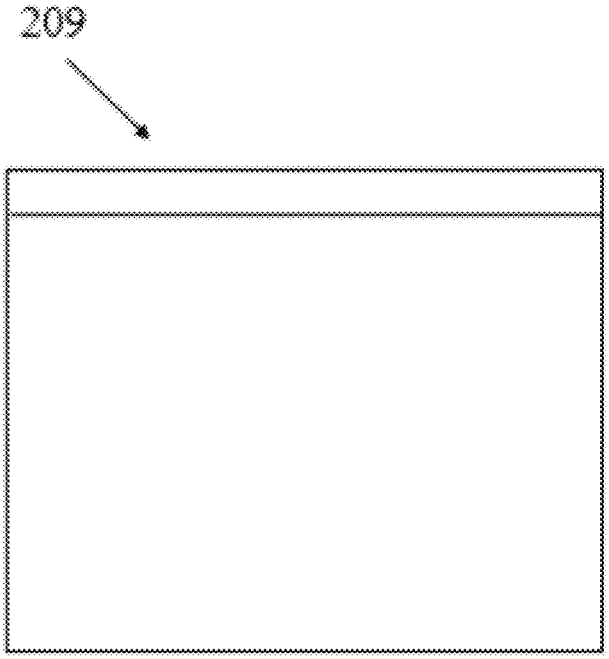
FIG. 20C is a back view of the panel filler connection member.
Figure 20D:
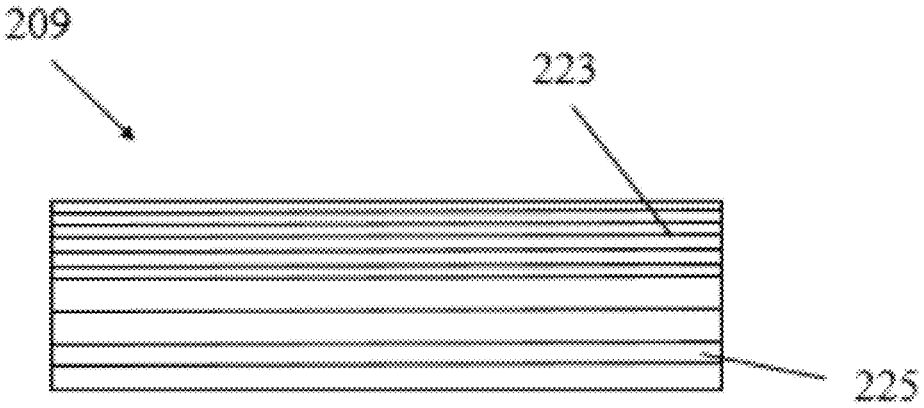
FIG. 20D is a bottom view of the panel filler connection member.

Referring more specifically to FIGS. 13, 14A and 15, the top hook member 184 of the panel connector member 181 is configured to fit over the top edge 187 of the panel hanger member 183 while allowing the bottom flange member 186 to be positioned underneath and/or in engagement with the bottom edge 189 of the panel hanger member 183. The top hook member 184 has a hook shape to enable hanging on panel hanger member 183. For instance, the top hook member 184 includes a top flange 201 which extends substantially perpendicular from a top of the panel connector member 181, and a back flange 203, which extends substantially perpendicular from the end of the top flange 201 and toward the bottom flange member 186. In some cases, a height of the back flange 203 may be minimized in order to reduce a gap between adjacent modular panels. For example, if a first modular panel is mounted and a second module panel is being mounted below the first one, then the second modular panel needs to be lifted up the height of the back flange 203 in order to be hung on the panel hanger member 183. As such, the height of the back flange 203 is proportional to a vertical gap between vertically adjacent modular panels. Further, the bottom flange member 186 extends substantially perpendicular from the bottom of the panel connector member 181. Optionally, the bottom flange member 186 may include a lip portion 205 extending toward the top hook member 184, e.g., at or near the edge of the bottom flange member 186, and having a height configured to increase engagement of the panel connector member 181 with the panel hanger member 183. For instance, in some configurations, as illustrated in FIG. 15, both the top hook member 184 and the bottom flange member 186 respectively engage the top edge 187 and the bottom edge 189 of the panel hanger member 183.

Referring specifically to FIGS. 14A-E through FIG. 17, it is noted that the panel attachment system 100 may include a base flange 166, which may also be referred to as a single wing aspect. For example if only one panel is required, the panel attachment system 100 may only include only one base flange of the base member 160, with the opposing base flange being removed. This alternative aspect allows for a single panel or a single row of panels to be added to a corner section of a wall of panels or at the end of a wall of panels, and is attached using the panel connector member 181 and panel hanger member 183 as discussed above in reference to FIG. 12 and FIG. 13.

Figure 14B:
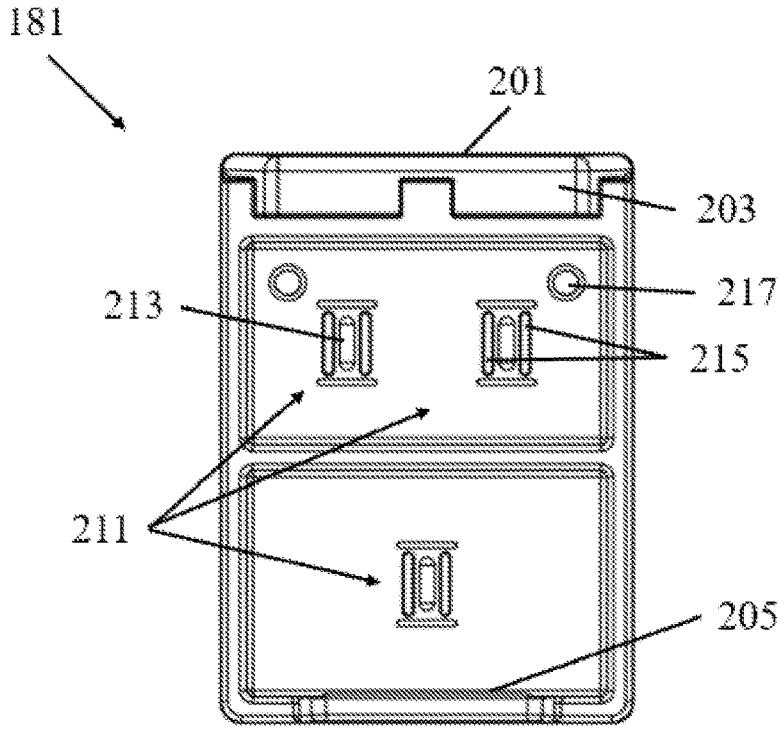
FIG. 14B is a front plan view of the panel connector member of FIG. 12.
Figure 14C:
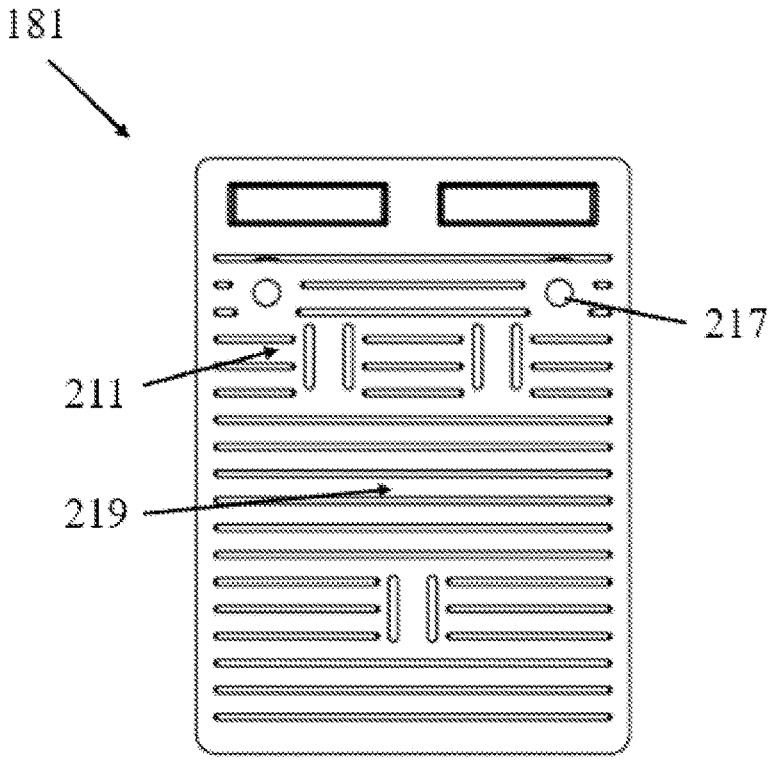
FIG. 14C is a back plan view of the panel connector member of FIG. 12.
Figure 14D:
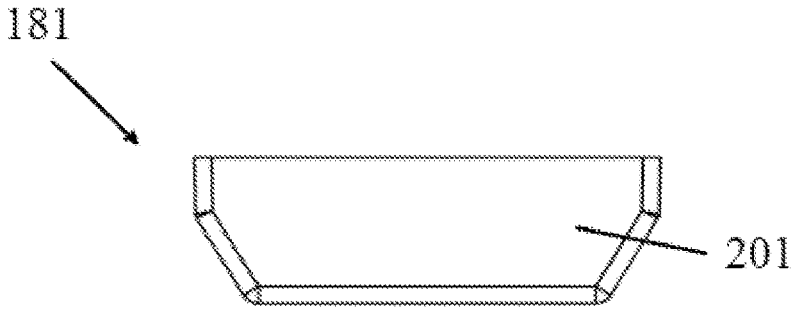
FIG. 14D is a top view of the panel connector member of FIG. 12.
Figure 14E:
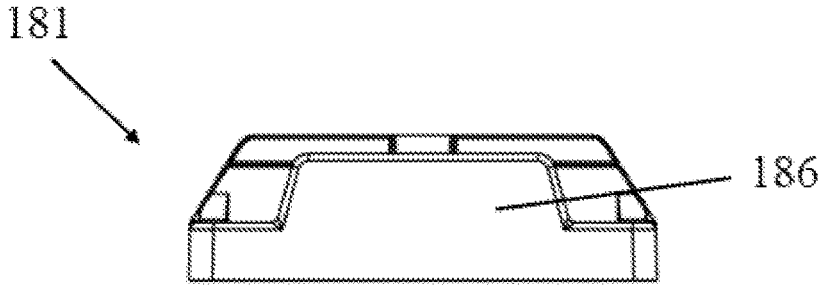
FIG. 14E is a bottom view of the panel connector member of FIG. 12.

Additionally as illustrated in FIG. 14C, the panel connector member 181 may include one or more increased surface area regions 219, which provide additional surface area. For example, the one or more increased surface area regions 219 are configured to receive an adhesive and allow the panel connector member 181 to be adhered to a corresponding modular panel, such as but not limited to a glass panel. Thus, the one or more increased surface area regions 219 provide the connection with additional strength.

Further, as illustrated in FIGS. 14B and 14C, the panel connector member 181 can be alternatively or additionally attachable to the corresponding modular panel using the attachment members 211. In this example, each of the attachment members 211 include a pair of attachment slots 215 sized to receive staples or an alternative attachment mechanism to fix the panel connector member 181 to the modular panel. Additionally the attachment members 211 may include a raised portion 213 to provide a support surface when curved staples are used to attach the panel connector member 181 to the corresponding modular panel. Alternatively, or in addition, the panel connector member 181 may be attached to the corresponding modular panel via one or more panel connector member openings 217, which define through-holes sized to receive a connector mechanism, such as but not limited to a screw.

Referring to FIGS. 18A-B, 19A-C, and 20A-D, in an alternative or additional aspect, the panel attachment system 100 may include a panel gap filler member 207 configured to fill a gap between two modular panels 520 positioned adjacent to one another. In an aspect, the panel gap filler member 207 is sized so as to create a flush outer surface across the adjacent panels 520. In one example, the panel gap filler member 207 has a body with a U-shaped cross-section that define respective flanges.

In an aspect, the panel gap filler member 207 may be additionally secured within the gap between the adjacent panels 520 via one or more panel filler connection members 209, which may be attached to a back of each of the modular panels 520. For example, opposing ends of the respective flanges of the panel gap filler member 207 each include a raised portion 221, which are configured to allow the panel gap filler member 207 to attach to the panel filler connection members 209. In one example, each panel filler connection member 209 has a body with an L-shaped cross-section, and which are fixed at an end portion of each panel 520 by an adhesive layer 225. Each of the panel filler connection members 209 include a first flange which attaches to the respective panel 520 and a second flange which extends from a back of the panel 520 toward a front of the panel 520, and thus toward the panel gap filler member 207. The second flange of the panel filler connection member 209 includes a panel filler engagement portion 223 on an inner surface to enhance a connection with the respective flange of the panel gap filler member 207. For example, but not limited hereto, the panel filler engagement portion 223 includes one or more ribs, which are configured to engage the respective flange of the panel gap filler member 207, and optionally the raised portion 221 extending from the flange. For instance, once the panel 520 with panel filler connection members 209 are mounted on support members 120 by the adjustable panel hangers 102, the panel gap filler member 207 may be pushed into the gap between adjacent panels 520 such that the raised portions 221 on the flanges extend over each of the ribbed portions 223. This attachment mechanism enhances attachment of the panel gap filler member 207 to the panel filler connection members 209 and in turn to the panels 520.

ADDITIONAL EMBODIMENTS

The following clauses include examples of one or more embodiments of the present disclosure.

1. A hanger system, comprising:

a connector member;

a base member configured to removably attach to the connector member and to clamp onto a support member, wherein the base member includes at least one base flange; and at least one hanger member adjustably attachable to the at least one base flange, wherein the at least one hanger member is configured to support a panel.

2. The hanger system of clause 1, wherein the connector member further comprises:

a connector channel extending into the connector member and configured to receive a support flange of the support member; and a connector flange configured to engage an interior surface of the support flange, wherein the connector flange extends in a direction perpendicular to the connector channel.

3. The hanger system of clause 2, wherein the connector channel further comprises:

a plurality of inner walls configured to engage each face of the support flange of the support member; and an opening configured to allow the connector channel to receive the support flange.

4. The hanger system of clause 3, wherein the connector channel and connector flange are flush with each surface of the support flange of the support member.

5. The hanger system of clause 1, wherein the base member further comprises a body portion, at least one base flange, and a connector flange, wherein the at least one base flange extends in a direction approximately parallel to the body portion, and wherein the connector flange extends in a direction approximately perpendicular to the body portion.

6. The hanger system of clause 5, wherein the at least one base flange is connected to a back side of the body portion such that the at least one base flange extends behind the body portion.

7. The hanger system of clause 6, wherein the base member is removably attached to the connector member via the connector flange such that the connector member engages an inner surface of the support member and the base member engages an outer surface of the support member such that the support member is clamped between the base member and the connector member.

8. The hanger system of clause 7, wherein the base member further includes at least one connector adjustment member, wherein the at least one connector adjustment member extends out of the body portion in an approximately perpendicular direction and engages the connector member, and wherein the at least one connector adjustment member may adjust a distance between the base member and the connector member, by extending or retracting, and thereby provide a clamping force to fix the base member and the connector member to the support member.

9. The hanger system of clause 8, wherein the base member further includes a plurality of base member adjustment members, wherein the plurality of base member adjustment members extend out of the body portion in a direction approximately perpendicular to a plane defined by the base member and engage the outer surface of the support member, and wherein the plurality of base member adjustment members are individually adjustable, and thereby allow an angle of the base member relative to the outer surface of the support member to be selectively adjusted.

10. The hanger system of clause 1, wherein the at least one hanger member is adjustably attachable to the at least one base flange via at least one hanger connecting member, and wherein the at least one hanger member is movable relative to the at least one base flange by adjusting a position of the at least one hanger connecting member.

11. The hanger system of clause 10, wherein the at least one hanger member is flush with the body portion when connected to the at least one base flange.

12. The hanger system of clause 1, further comprising at least one panel connector member attached to a top end of the at least one hanger member.

13. The hanger system of clause 1, further comprising:

a modular panel removably attachable to the at least one hanger member.

14. The hanger system of clause 13, wherein the modular panel is connectable to the base member via the at least one hanger member.

15. The hanger system of clause 1, further comprising a modular panel removably attachable to the at least one hanger member, wherein the modular panel further comprises at least one panel connector member attached to a back face of the modular panel, and wherein the at least one hanger member is configured to receive the at least one panel connector member so as to allow the modular panel to be removably attached to the at least one hanger member and in turn to be attached to and removed from the support member via the at least one hanger member and the base member.

16. The hanger system of clause 15, further comprising:

a connector adjustment member; and a base member adjustment member;

wherein at least one of a position or an angle of the modular panel relative to the support member is adjustable by selectively adjusting at least one of the connector adjustment member, the base member adjustment members, or the at least one hanger connecting member.

17. The hanger system of clause 16, wherein the at least one hanger member further includes a first hanger member and a first magnetic attachment member, and wherein the panel connector member further includes a first panel connector member and a second magnetic attachment member, wherein at least one of the first magnetic attachment member or the second magnetic attachment member is configured to be attracted to an opposite one of the first magnetic attachment member or the second magnetic attachment member.

18. The hanger system of clause 1, wherein at least one of:

a first distance between a vertical center of the base member and each of a first vertical edge and an opposing second vertical edge of a front surface of the base member is equal, or the base member includes a first base flange and a second base flange each extending from opposing sides of the base member, wherein the first base flange includes a first connecting member and the second base flange includes a second connecting member, and wherein a second distance between the vertical center of the base member and each of the first connecting member and the second connecting member is equal.

19. The hangar system of clause 1, further comprising a panel connector member having a top hook member and a bottom flange member configured to fit over the at least one panel hanger member.

20. The hanger system of clause 1, further comprising:

a first modular panel removably attachable to at first one of the at least one hanger member;

a second modular panel removably attachable to at second one of the at least one hanger member, wherein the second modular panel is spaced apart by a gap from the first modular panel; and a panel gap filler member positioned in the gap between the first modular panel and the second module panel.

21. A hanger system, comprising:

a connector member, wherein the connector member further comprises a connector channel configured to receive a support flange of a support member and a connector flange;

a base member configured to removably attach to the connector flange of the connector member, wherein the base member and connector member clamp onto the support member, and wherein the base member includes at least one base flange;

at least one hanger member removably attachable to the at least one base flange via at least one hanger connecting member, and wherein the at least one hanger member is movable relative to the at least one base flange;

a modular panel comprising at least one panel connector member attached to a back face of the modular panel, wherein the at least one panel connector member is removably connectable with the at least one hanger member;

at least one connector adjustment member configured to adjustably extend out of the base member to allow adjustment of a distance between the base member and the connector member;

at least one base member adjustment member configured to adjustably extend out of the at least one hanger member and engage an outer surface of the support member to allow an angle of the base member relative to the outer surface of the support member to be selectively adjusted; and wherein a position and angle of the modular panel relative to the support member is adjustable by selectively adjusting the at least one connector adjustment member, the at least one base member adjustment member, or the at least one hanger connecting member.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. A hanger system, comprising:

a connector member;

a base member configured to removably attach to the connector member and to clamp onto a support member, wherein the base member includes at least one base flange;

at least one hanger member adjustably attachable to the at least one base flange, wherein the at least one hanger member is configured to support a panel; and at least one panel connector member having a top hook member and a bottom flange member configured to fit over the at least one panel hanger member.

2. The hanger system of claim 1, wherein the connector member further comprises:

a connector channel extending into the connector member and configured to receive a support flange of the support member; and a connector flange configured to engage an interior surface of the support flange, wherein the connector flange extends in a direction perpendicular to the connector channel.

3. The hanger system of claim 2, wherein the connector channel further comprises:

a plurality of inner walls configured to engage each face of the support flange of the support member; and an opening configured to allow the connector channel to receive the support flange.

4. The hanger system of claim 3, wherein the connector channel and connector flange are flush with each surface of the support flange of the support member.

5. The hanger system of claim 1, wherein the base member further comprises a body portion, at least one base flange, and a connector flange, wherein the at least one base flange extends in a direction approximately parallel to the body portion, and wherein the connector flange extends in a direction approximately perpendicular to the body portion.

6. The hanger system of claim 5, wherein the at least one base flange is connected to a back side of the body portion such that the at least one base flange extends behind the body portion.

7. The hanger system of claim 6, wherein the base member is removably attached to the connector member via the connector flange such that the connector member engages an inner surface of the support member and the base member engages an outer surface of the support member such that the support member is clamped between the base member and the connector member.

8. The hanger system of claim 7, wherein the base member further includes at least one connector adjustment member, wherein the at least one connector adjustment member extends out of the body portion in an approximately perpendicular direction and engages the connector member, and wherein the at least one connector adjustment member may adjust a distance between the base member and the connector member, by extending or retracting, and thereby provide a clamping force to fix the base member and the connector member to the support member.

9. The hanger system of claim 8, wherein the base member further includes a plurality of base member adjustment members, wherein the plurality of base member adjustment members extend out of the body portion in a direction approximately perpendicular to a plane defined by the base member and engage the outer surface of the support member, and wherein the plurality of base member adjustment members are individually adjustable, and thereby allow an angle of the base member relative to the outer surface of the support member to be selectively adjusted.

10. The hanger system of claim 1, wherein the at least one hanger member is adjustably attachable to the at least one base flange via at least one hanger connecting member, and wherein the at least one hanger member is movable relative to the at least one base flange by adjusting a position of the at least one hanger connecting member.

11. The hanger system of claim 10, wherein the at least one hanger member is flush with the body portion when connected to the at least one base flange.

12. The hanger system of claim 1, further comprising:

a modular panel removably attachable to the at least one hanger member.

13. The hanger system of claim 12, wherein the modular panel is connectable to the base member via the at least one hanger member.

14. The hanger system of claim 1, further comprising a modular panel removably attachable to the at least one hanger member, wherein the modular panel further comprises the at least one panel connector member attached to a back face of the modular panel, and wherein the at least one hanger member is configured to receive the at least one panel connector member so as to allow the modular panel to be removably attached to the at least one hanger member and in turn to be attached to and removed from the support member via the at least one hanger member and the base member.

15. The hanger system of claim 14, further comprising:

a connector adjustment member; and a base member adjustment member;

wherein at least one of a position or an angle of the modular panel relative to the support member is adjustable by selectively adjusting at least one of the connector adjustment member, the base member adjustment members, or the at least one hanger connecting member.

16. The hanger system of claim 15, wherein the at least one hanger member further includes a first hanger member and a first magnetic attachment member, and wherein the at least one panel connector member further includes a first panel connector member and a second magnetic attachment member, wherein at least one of the first magnetic attachment member or the second magnetic attachment member is configured to be attracted to an opposite one of the first magnetic attachment member or the second magnetic attachment member.

17. The hanger system of claim 1, wherein at least one of:

a first distance between a vertical center of the base member and each of a first vertical edge and an opposing second vertical edge of a front surface of the base member is equal, or the base member includes a first base flange and a second base flange each extending from opposing sides of the base member, wherein the first base flange includes a first connecting member and the second base flange includes a second connecting member, and wherein a second distance between the vertical center of the base member and each of the first connecting member and the second connecting member is equal.

18. The hanger system of claim 1, further comprising:

a first modular panel removably attachable to at first one of the at least one hanger member;

a second modular panel removably attachable to at second one of the at least one hanger member, wherein the second modular panel is spaced apart by a gap from the first modular panel; and a panel gap filler member positioned in the gap between the first modular panel and the second module panel.

19. A hanger system, comprising:

a connector member, wherein the connector member further comprises a connector channel configured to receive a support flange of a support member and a connector flange;

a base member configured to removably attach to the connector flange of the connector member, wherein the base member and connector member clamp onto the support member, and wherein the base member includes at least one base flange;

at least one hanger member removably attachable to the at least one base flange via at least one hanger connecting member, and wherein the at least one hanger member is movable relative to the at least one base flange;

a modular panel comprising at least one panel connector member attached to a back face of the modular panel, wherein the at least one panel connector member is removably connectable with the at least one hanger member;

at least one connector adjustment member configured to adjustably extend out of the base member to allow adjustment of a distance between the base member and the connector member;

at least one base member adjustment member configured to adjustably extend out of the at least one hanger member and engage an outer surface of the support member to allow an angle of the base member relative to the outer surface of the support member to be selectively adjusted; and wherein a position and angle of the modular panel relative to the support member is adjustable by selectively adjusting the at least one connector adjustment member, the at least one base member adjustment member, or the at least one hanger connecting member.

20. A hanger system, comprising:

a connector member;

a base member configured to removably attach to the connector member and to clamp onto a support member, wherein the base member includes at least one base flange;

at least one hanger member adjustably attachable to the at least one base flange, wherein the at least one hanger member is configured to support a panel;

wherein the connector member further comprises:

a connector channel extending into the connector member and configured to receive a support flange of the support member; and a connector flange configured to engage an interior surface of the support flange, wherein the connector flange extends in a direction perpendicular to the connector channel; and wherein the connector channel further comprises:

a plurality of inner walls configured to engage each face of the support flange of the support member; and an opening configured to allow the connector channel to receive the support flange.

21. A hanger system, comprising:

a connector member;

a base member configured to removably attach to the connector member and to clamp onto a support member, wherein the base member includes at least one base flange;

at least one hanger member adjustably attachable to the at least one base flange, wherein the at least one hanger member is configured to support a panel; and wherein the at least one hanger member is adjustably attachable to the at least one base flange via at least one hanger connecting member, and wherein the at least one hanger member is movable relative to the at least one base flange by adjusting a position of the at least one hanger connecting member.

22. A hanger system, comprising:

a connector member;

a base member configured to removably attach to the connector member and to clamp onto a support member, wherein the base member includes at least one base flange;

at least one hanger member adjustably attachable to the at least one base flange, wherein the at least one hanger member is configured to support a panel;

a modular panel removably attachable to the at least one hanger member, wherein the modular panel further comprises at least one panel connector member attached to a back face of the modular panel, and wherein the at least one hanger member is configured to receive the at least one panel connector member so as to allow the modular panel to be removably attached to the at least one hanger member and in turn to be attached to and removed from the support member via the at least one hanger member and the base member;

a connector adjustment member;

a base member adjustment member; and wherein at least one of a position or an angle of the modular panel relative to the support member is adjustable by selectively adjusting at least one of the connector adjustment member, the base member adjustment members, or the at least one hanger connecting member.

* * * * *